US009673527B2

(12) United States Patent
Yoon et al.

(10) Patent No.: US 9,673,527 B2
(45) Date of Patent: Jun. 6, 2017

(54) FOLDED PATCH ANTENNA PLATFORM

(75) Inventors: Yong-Kyu Yoon, Gainesville, FL (US); Gloria Jung-a Kim, Gainesville, FL (US); Xiaoyu Cheng, Gainesville, FL (US)

(73) Assignee: University of Florida Research Foundation, Inc., Gainesville, FL (US)

( * ) Notice: Subject to any disclaimer, the term of this patent is extended or adjusted under 35 U.S.C. 154(b) by 348 days.

(21) Appl. No.: 14/126,950

(22) PCT Filed: Jul. 6, 2012

(86) PCT No.: PCT/US2012/045745

§ 371 (c)(1),
(2), (4) Date: Dec. 17, 2013

(87) PCT Pub. No.: WO2013/006788

PCT Pub. Date: Jan. 10, 2013

(65) Prior Publication Data

US 2014/0139385 A1 May 22, 2014

Related U.S. Application Data

(60) Provisional application No. 61/505,327, filed on Jul. 7, 2011.

(51) Int. Cl.
*H01Q 9/04* (2006.01)
*H01Q 1/24* (2006.01)
(Continued)

(52) U.S. Cl.
CPC ..... *H01Q 9/0442* (2013.01); *H01Q 1/24* (2013.01); *H01Q 1/273* (2013.01); *H01Q 1/38* (2013.01); *H01Q 5/364* (2015.01); *H01Q 9/0414* (2013.01)

(58) Field of Classification Search
CPC ..... H01Q 9/0442; H01Q 9/0414
See application file for complete search history.

(56) References Cited

U.S. PATENT DOCUMENTS 6,232,923 B1 5/2001 Guinn et al.
2007/0024399 A1* 2/2007 Martin Antolin ..... H01Q 9/265 333/205

(Continued)

FOREIGN PATENT DOCUMENTS

JP 2010062979 A 3/2010
WO 2011022101 A2 2/2011

OTHER PUBLICATIONS

International Search Report and Written Opinion dated Jan. 24, 2013.

(Continued)

*Primary Examiner* — Hoang Nguyen
*Assistant Examiner* — Michael Bouizza
(74) *Attorney, Agent, or Firm* — Thomas Horstemeyer, LLP

(57) ABSTRACT

Various systems and methods are provided for folded patch antennas. In one embodiment, among others, a folded patch antenna includes a patch disposed on an outer side of a flexible substrate and a ground plane disposed on an inner side of the flexible substrate opposite the patch. The flexible substrate is folded to form an enclosed cavity defined by the inner side of the flexible substrate. The ground plane may provide electromagnetic interference (EMI) shielding of the cavity. In another embodiment, among others, a folded patch antenna platform includes a flexible substrate, a folded patch antenna, and a transceiver mounted on the flexible substrate. The folded patch antenna includes a patch communicatively coupled to the transceiver and a ground plane, which are disposed on opposite sides of the flexible substrate.

20 Claims, 21 Drawing Sheets

(51) Int. Cl.

| | |
|---|---|
| ***H01Q 1/27*** | (2006.01) |
| ***H01Q 1/38*** | (2006.01) |
| ***H01Q 5/364*** | (2015.01) |

(56) References Cited

U.S. PATENT DOCUMENTS

| | | | | |
|---|---|---|---|---|
| 2010/0007561 | A1 | 1/2010 | Bucca et al. | |
| 2010/0036369 | A1* | 2/2010 | Hancock | A61N 5/04 606/33 |

OTHER PUBLICATIONS

Cheng, X., Whalen, J.J. and Yoon Y.K. "Rectangular waveguide shape folded patch antenna," IEEE Antennas and Propagation Society International Symposium (APS), pp. 1-4, Jul. 2010.

Cheng, X., Shi, J., Kim, J., Kim, C., Senior, D.E. and Yoon Y.K. "Compact Self-Packaged Active Folded Patch Antenna with Omni-directional Radiation Pattern," IEEE Electronic Components and Technology Conference (ECTC), pp. 1041-1046, May 2011.

Cheng, X., Shi, J., Kim, J., Kim, C., Senior, D.E. and Yoon Y.K. "A Compact Self-Packaged Patch Antenna in Rectangular Waveguide Shape," IEEE Int. Symp. on Antennas and Propagation (APSURSI), pp. 888-890, Jul. 2011.

Cheng, X., Shi, J., Kim, J., Kim, C., Senior, D.E. and Yoon Y.K. "A Compact Self-Packaged Patch Antenna with Non-Planar Complimentary Split Ring Resonator Loading," IEEE Int. Symp. on Antennas and Propagation (APSURSI), pp. 1036-1039, Jul. 2011.

* cited by examiner (a)

(b)

FOLDED PATCH ANTENNA PLATFORM

CROSS-REFERENCE TO RELATED APPLICATION(S)

This application is the 35 U.S.C. §371 national stage of PCT application PCT/US2012/045745, filed Jul. 6, 2012, which claims priority to and the benefit of U.S. Provisional Application Ser. No. 61/505,327, filed Jul. 7, 2011, both of which are hereby incorporated by reference herein in their entirety.

STATEMENT REGARDING FEDERALLY SPONSORED RESEARCH OR DEVELOPMENT

This invention was made with government support under agreements ECCS 0748153 and 11324413 awarded by the National Science Foundation (NSF). The Government has certain rights in the invention.

BACKGROUND

With the advance of modern electronics technology, the overall electronics size becomes smaller while the size of a resonance antenna is constrained to its wavelength in a quarter or a half wavelength at a given frequency, often resulting in the largest part of a wireless system being its antenna. A microstrip patch antenna is one of the most popular resonance antennas due to its light weight and easy fabrication and therefore widely used for many commercial electronic devices such as GPS receivers and for military applications such as airborne and aerospace communication. It is usually composed of a metallic patch and a ground plane with a dielectric layer sandwiched in between. Because of the simple structure, a patch is easy to fabricate using standard PCB fabrication techniques, making it suitable for low cost and mass production.

BRIEF DESCRIPTION OF THE DRAWINGS

Many aspects of the present disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

Figure 1A:
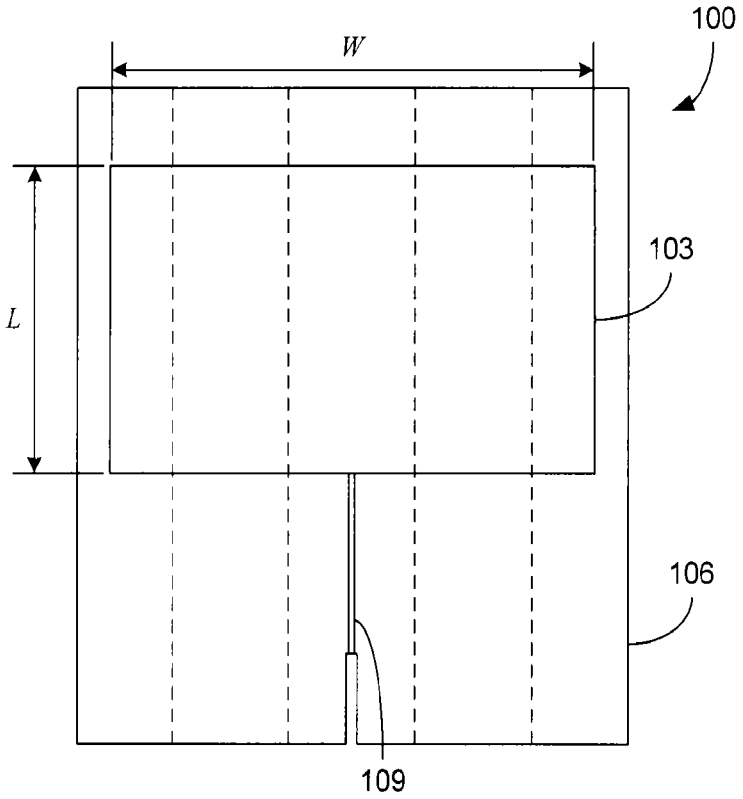
FIGS. 1A and 1B are graphical representations of an example of a folded patch antenna in accordance with various embodiments of the present disclosures.

Disclosed herein are various systems and methods related to folded patch antennas and flexible electronics platforms including a foldable patch antenna. Quasi-omnidirectionally radiating, compact, folded patch antennas in rectangular and cylindrical waveguide shapes are disclosed. When folded or wrapped, the ground plane of the patch antenna creates an enclosed space or cavity that is electromagnetic interference (EMI) protected and can be used for electronic circuit implementations with little EMI from the patch antenna. The antennas can be used for a variety of commercial, military, and bio-medical applications such as, e.g., compact global positioning systems (GPS) and wireless endoscopes for gastro-intestinal monitoring. Reference will now be made in detail to the description of the embodiments as illustrated in the drawings, wherein like reference numbers indicate like parts throughout the several views.

Figure 1B:
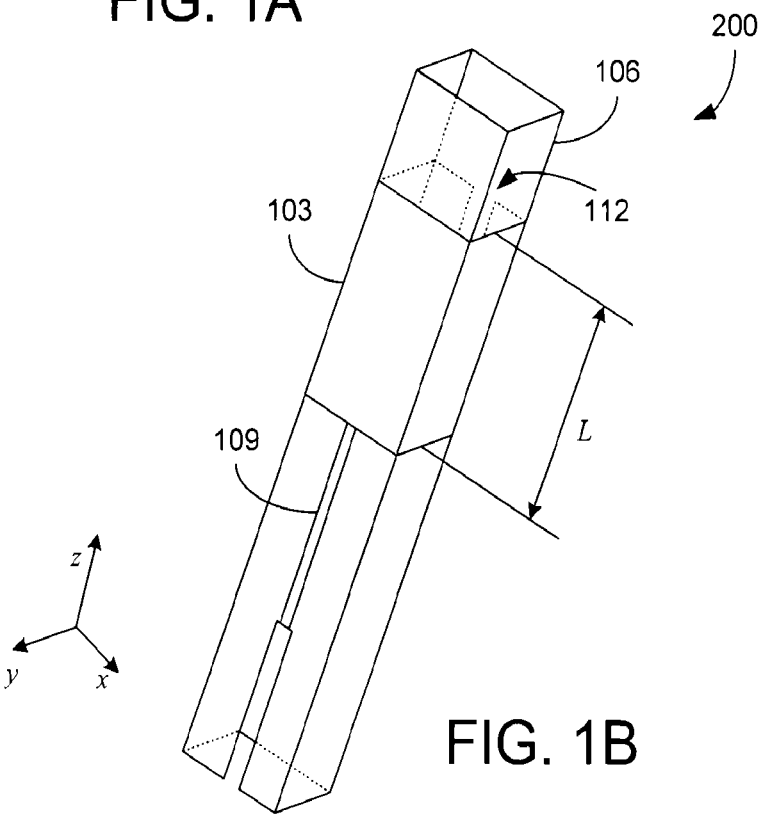

Conventional patch antennas include conductors disposed on opposite sides of a substrate, which act as a radiation patch and a ground plane. Referring to FIGS. 1A and 1B, shown is a conventional patch antenna 100 including a patch 103 disposed on a substrate 106 with a dielectric constant of 2.33 and a thickness of 30 mil. The ground plane is disposed on the other side of the substrate 103. The ground plane may extend beyond the area covered by the patch 106. An approximate patch length L can be calculated by the following equation:

$$L = 0.49\frac{\lambda}{\sqrt{\varepsilon_r}} \qquad \text{EQN. 1}$$

where λ is the free space wavelength of the radiating frequency and $\epsilon_r$ is the relative permittivity of the substrate. The dielectric constant of the substrate 106 significantly affects the antenna length.

The conventional antenna length (in the z-direction) can be determined to be 40 mm for a resonance radiation frequency of 2.4 GHz antenna when a width (x-direction) is chosen to be 70 mm. A piece of quarter wavelength (λ/4) transformer may be used as a feeding line 109 for impedance matching. By varying the width of the feeding line 109, the characteristic impedance of the transformer may be adjusted for impedance matching. The length of the λ/4 transformer may also be determined with respect to the substrate characteristics. When a flexible substrate is used, the conventional patch of FIG. 1A can be folded along the dashed lines into a rectangular waveguide shape shown in FIG. 1B. This folded antenna 200 has the same antenna length of 40 mm (z-direction) and the waveguide has a cross-sectional dimension 20 mm×20 mm, which significantly reduces its footprint. The edges of the folded patch do not meet each other but are separated by a tuning gap 112 between the edges. This gap 112 may be further cut away to satisfy the impedance matching, which would eliminate the need for the λ/4 transformer as the feeding line 109.

Figure 2A:
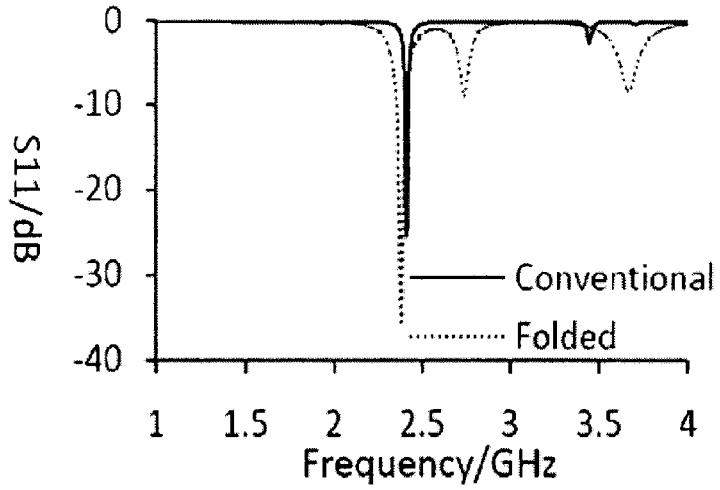
FIGS. 2A, 2B, 4, 5 and 9B are representations of simulation and measurement results for the folded patch antenna of FIGS. 1A and 1B in accordance with various embodiments of the present disclosures.
Figure 2B:
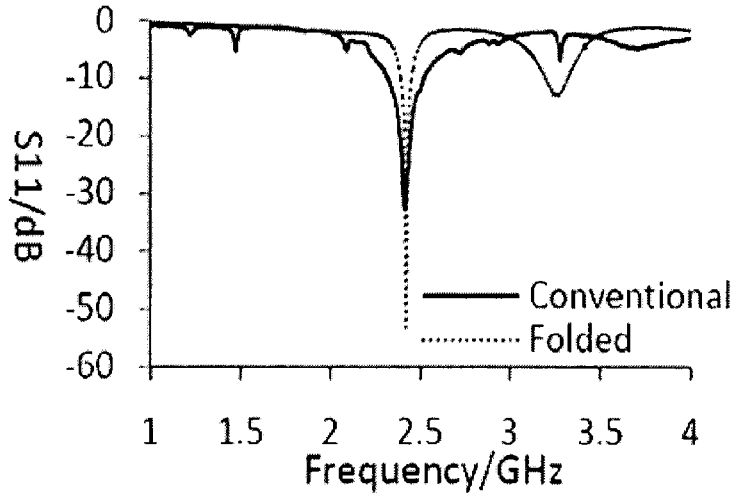

Referring to FIGS. 2A and 2B, shown are simulation and measurement results for the conventional and folded patch antennas 100 and 200, respectively. The simulation was preformed using High Frequency Structure Simulator (HFSS, Ansoft, Inc.), a three-dimensional full wave solver. FIG. 2A shows that the maximum return losses of the conventional patch antenna 100 and folded patch antenna 200 are 25.4 dB at 2.41 GHz and 35.4 dB at 2.38 GHz, respectively.

Figure 3A:
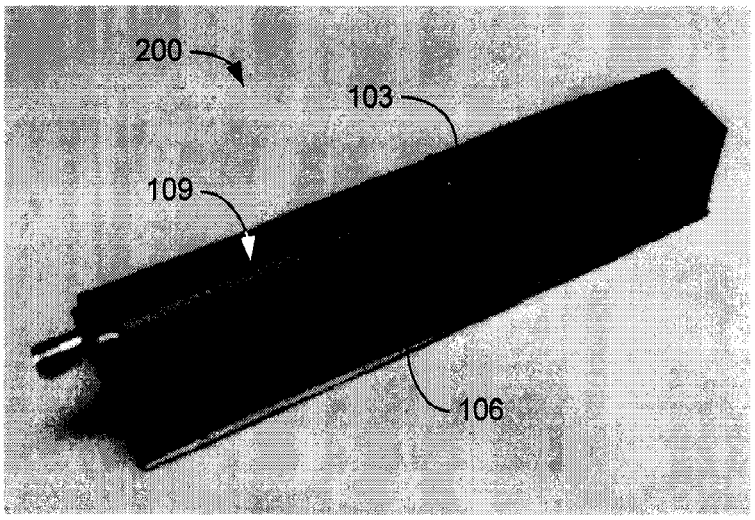
FIGS. 3A and 3B are images of the folded patch antenna of FIGS. 1A and 1B in accordance with various embodiments of the present disclosures.
Figure 3B:
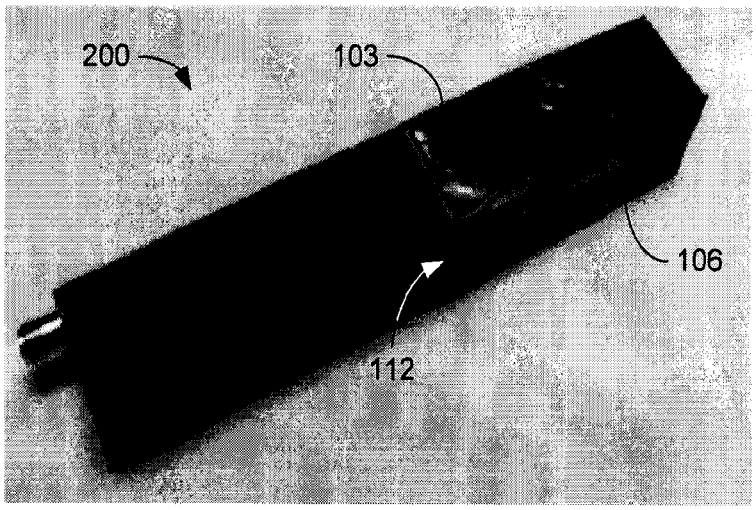

FIGS. 3A and 3B show views of the folded patch antenna 200 that was fabricated using a Rogers RT5870 substrate 106 whose permittivity and thickness are 2.33 and 30 mil, respectively. FIG. 3A shows the side including the feeding line 109 and FIG. 3B shows the opposite side including the tuning gap 112. Measurements on the folded patch antenna 200 were performed using an HP 8510C vector network analyzer after a standard 1-port calibration between 1 GHz and 4 GHz. FIG. 2B shows that the measured return losses of the conventional and folded patch antennas 100 and 200 were 32.2 dB at 2.4 GHz and 53 dB at 2.41 GHz, respectively. This indicates a very good impedance matching for the folded patch antenna 200.

Figure 4:
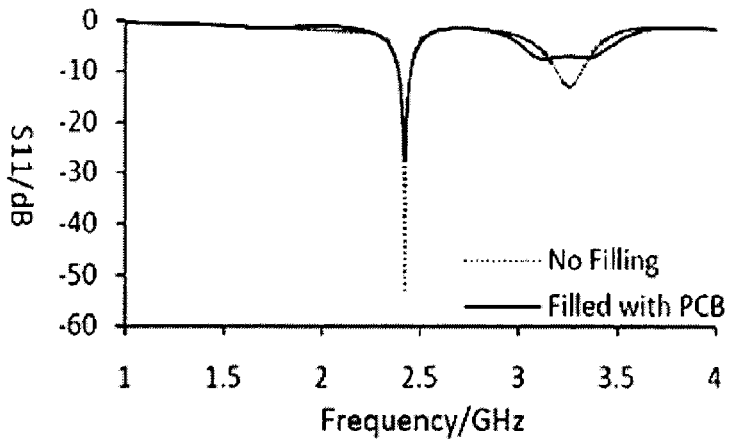
Figure 5:
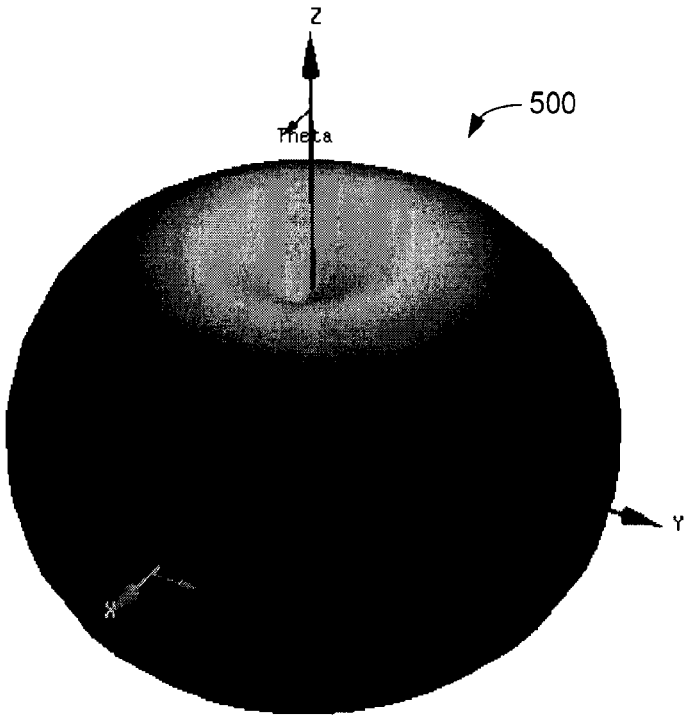

In order to examine EMI effect when circuitry is included within the antenna, the internal space of the folded patch antenna 200 was filled with pieces of printing circuit boards (PCBs) and the return loss measured. FIG. 4 shows the performance of the folded patch antenna with and without PCB filling. The resonance frequency remained the same at 2.41 GHz while the maximum return loss was reduced to 27.2 dB. The radiation pattern was also simulated with and without PCB filling. Both indicated quasi-omnidirectional radiation patterns with very little difference in maximum antenna gains. The maximum gain observed without PCB filling was 1.10 dB and with PCB filling was 1.13 dB. FIG. 5 shows the simulated folded patch antenna radiation pattern 500 with the PCB filling. The folded patch antenna shows an overall even radiation pattern in the x-y plane.

As illustrated, a folded patch antenna 200 can be implemented in a shielded rectangular waveguide shape with a center frequency of 2.4 GHz. By carefully adjusting the tuning gap 112 between both edges of the folded patch 103, the input impedance of the patch antenna can be successfully controlled without using an additional transformer. The antenna results show a quasi-omnidirectional radiation pattern and both simulation and measurement results exhibited good agreement. The antenna performance changed very little with PCB boards inserted inside the cavity formed by the folded antenna due to the EMI shielding effect of the ground plane. This makes the folded patch antenna 200 useful for a compact system needing a quasi-omnidirectional radiation pattern with the circuitry protected in the cavity. Such applications can include, e.g., a wireless endoscope.

A more compact self-packaged folded patch antenna may be achieved by adding vias between the patch 103 and the ground and/or by adding inductive slots (or dents) along the edge of the patch 103. According to EQN. 1, once an operational frequency is given, a patch antenna length L can be determined for the given dielectric substrate 106. Electric shorting vias may be used to reduce the size of the antenna. By including an array of vias along the top edge of the patch 103, the electromagnetic wave will be forced to ground and thus reduce the antenna length L. In alternative implementations, the reduction in patch antenna size may be achieved by applying inductive slots on the patch 103. From the resonance point of view, by forcing the antenna to work at lower frequency (e.g., make the antenna length L smaller than half wavelength), the input impedance of the patch antenna will be capacitive, that is, the imaginary part of the input impedance would be negative while the real part tends to be zero. The further the antenna size is reduced, the more capacitive the structure will be. To compensate for the capacitive impedance, inductive slots may be applied on the edges of the patch 103. To achieve significant size reduction, multiple dents are desirable.

Figure 6:
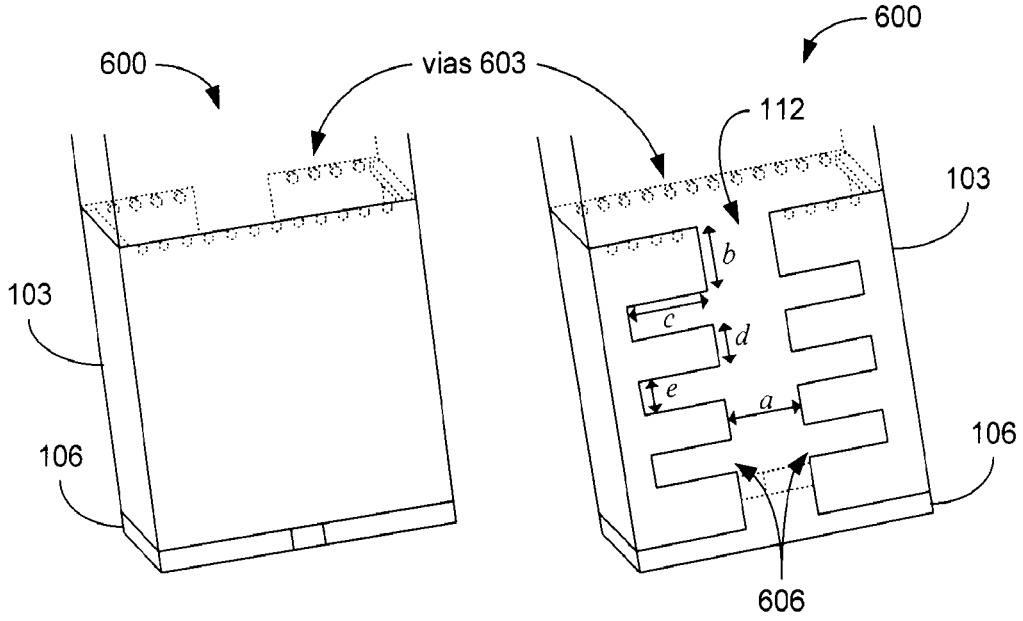
FIG. 6 is a graphical representation of another example of a folded patch antenna in accordance with various embodiments of the present disclosures.

The folded patch antenna described above with respect to FIGS. 1A and 1B was designed based on EQN. 1. For 2.4 GHz, it has the same length L as a normal patch antenna. Referring to FIG. 6, shown is a folded patch antenna 600 including a combination of both shorting vias 603 and inductive slots (or dents) 606 for size reduction. The antenna was fabricated on a flexible dielectric substrate 106 with a relative permittivity of 2.33 and a thickness of 31 mil. The vertical length of the patch was determined to be 19 mm, the cross section of the antenna has an area of 20 mm×20 mm. Electric vias 603 were distributed along the edge of the patch as illustrated. The vias have a diameter of 0.75 mm and a pitch between vias of 1.5 mm. Inductive slots 606 are also included on the back side of the antenna adjacent to the tuning gap 112. In the example of FIG. 6, six inductive slots 606 are placed on the two edges of the patch 103. The dimensions of the inductive slots 606 and tuning gap 112 are shown in FIG. 6, where a=5 mm, b=3.75 mm, c=5.5 mm, d=2.75 mm, and e=2 mm. By including the inductive slots (or dents) 606, additional current paths are formed, helping with impedance matching. Comparing the folded patch antenna 600 of FIG. 6 with the folded patch antenna 200 of FIG. 1B, the folded patch antenna 600 with vias 603 still radiates at 2.4 GHz, but the device length has been reduced from 40 mm to 19 mm, which corresponds to a volume reduction of about 52.5%.

Usually a patch antenna uses an impedance matching circuit for better operation. The input impedance of the patch antenna is strongly associated with the ratio of the width of the antenna to the length of the antenna (W/L). It can be approximated as:

$$Z_{in} = 90 \times \frac{\varepsilon_r^2}{\varepsilon_r - 1} \times \left(\frac{L}{W}\right)^2. \quad \text{EQN. 2}$$

By designing the antenna structure carefully, the input impedance can be adjusted to allow operation without an additional impedance matching circuit. It should be noticed that the circumference of the antenna (equivalently, W) as well as the inductive slots 606 are chosen to remove the need for an external matching scheme to be connected to a 50 ohm system.

Figure 7:
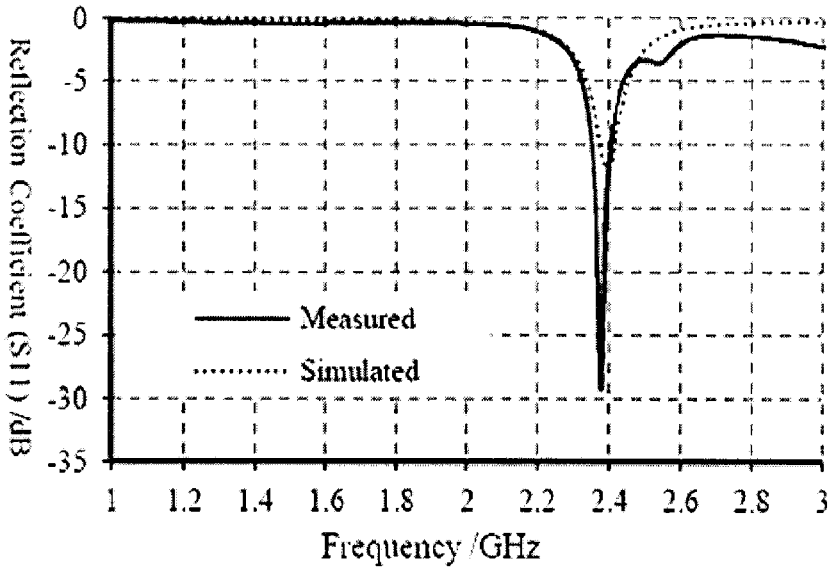
FIGS. 7, 8A, 8B, and 9A are representations of simulation and measurement results for the folded patch antenna of FIG. 6 in accordance with various embodiments of the present disclosures.
Figure 8A:
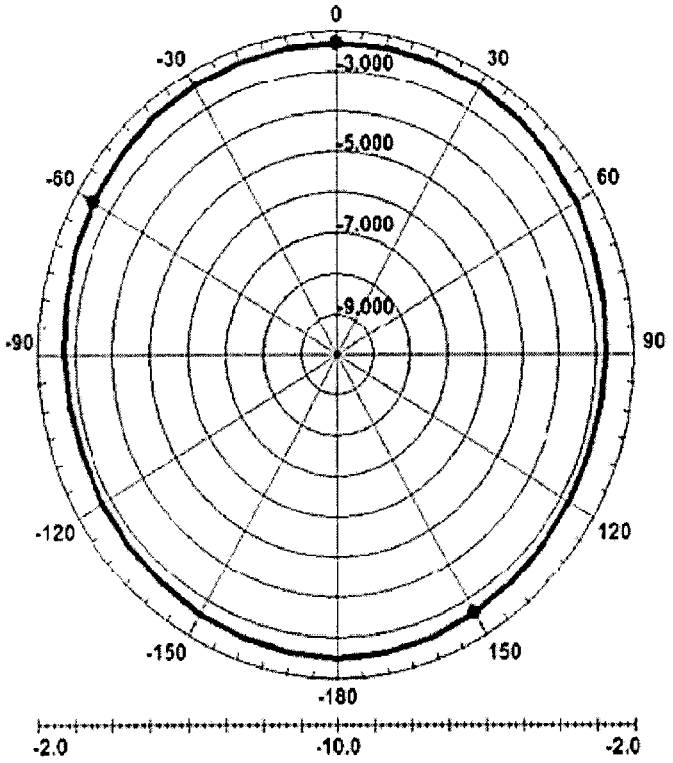
Figure 8B:
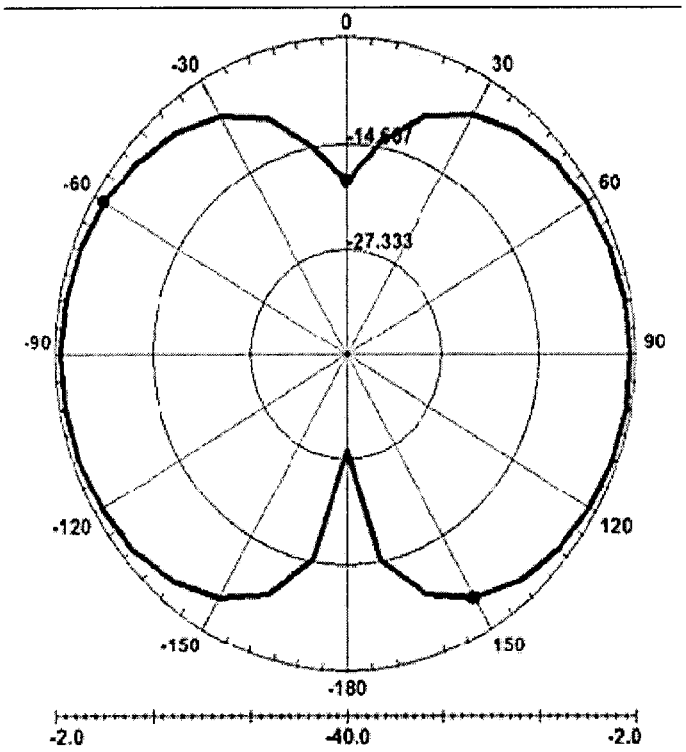
Figure 9A:
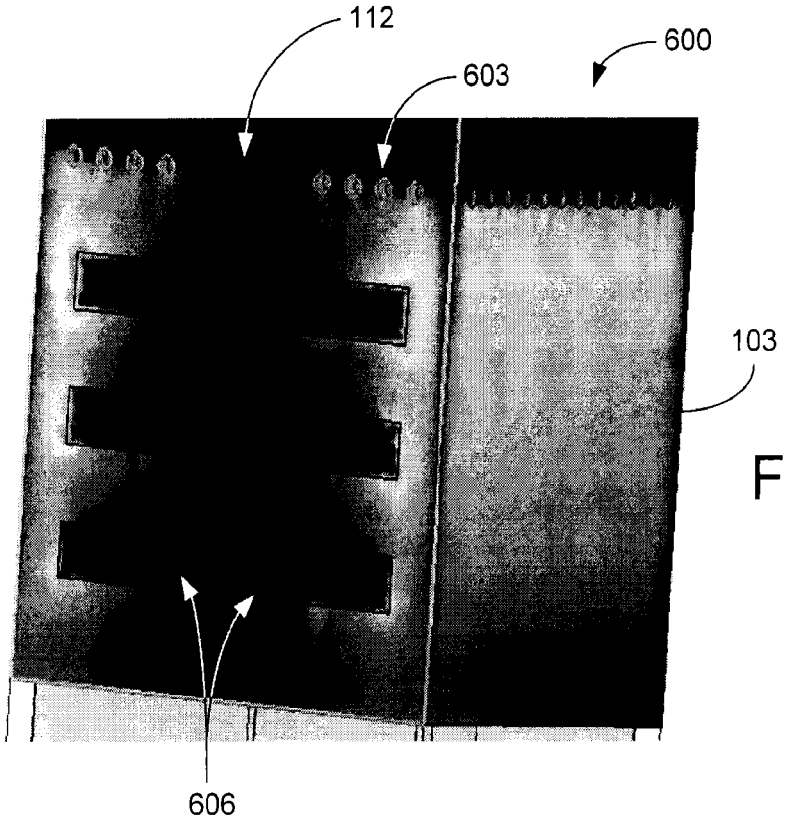
Figure 9B:
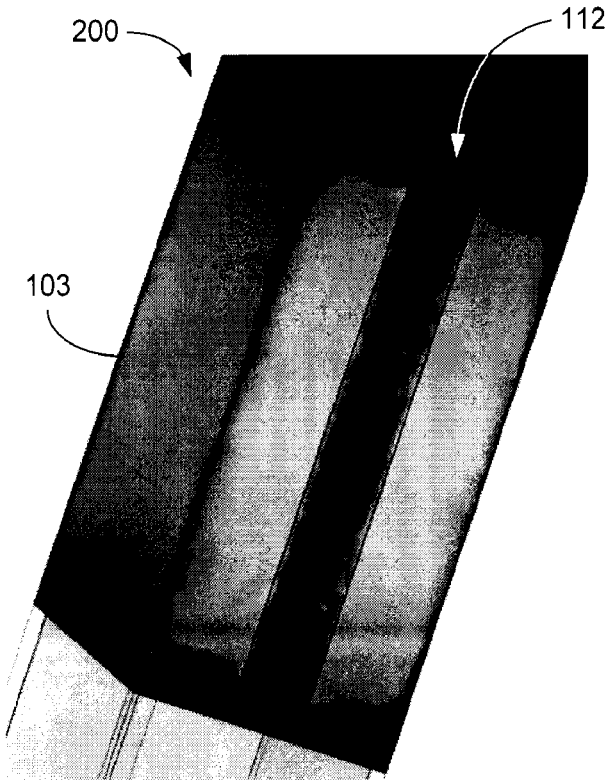

Numerical simulation was performed in HFSS (Ansys Inc.) which is a 3D full wave electromagnetic solver based on the finite element method (FEM). Referring to FIG. 7, simulated S11 is shown to be −12.12 at 2.4 GHz. FIGS. 8A and 8B also show the simulated radiation patterns in the H-plane (x-y plane) and in the E-plane (y-z plane), respectively. FIGS. 8A and 8B show a quasi-omni directional pattern, however there is 0.6 dB directivity in the x-direction (i.e. toward the inductive slot direction). It is because the current tends to flow on the edge of the antenna patch 103. There is a higher surface current density on the x-side. This is verified in FIG. 9A where the surface current density of the folded patch antenna 600 is plotted at 2.4 GHz. When compared with the surface current density of the folded patch antenna 200 shown in FIG. 8B, the areas at the ends of the inductive slots 606 show higher current levels then seen at the edges of the patch 103 without inductive slots. The realized gain is approximately 0.6 dB and the radiation efficiency of this folded patch antenna 600 may be as high as 88%.

Figure 10:
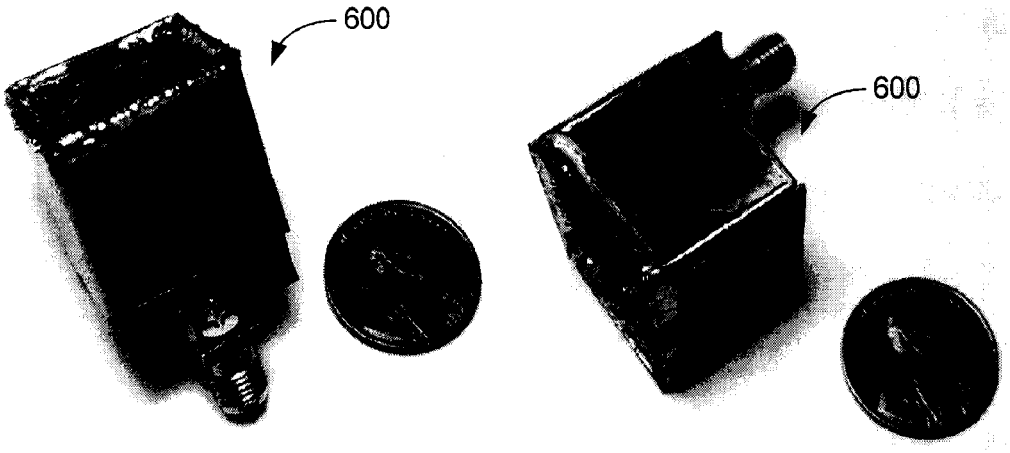
FIGS. 10 and 11 are images of the folded patch antennas of FIGS. 1A, 1B and 6 in accordance with various embodiments of the present disclosures.
Figure 11:
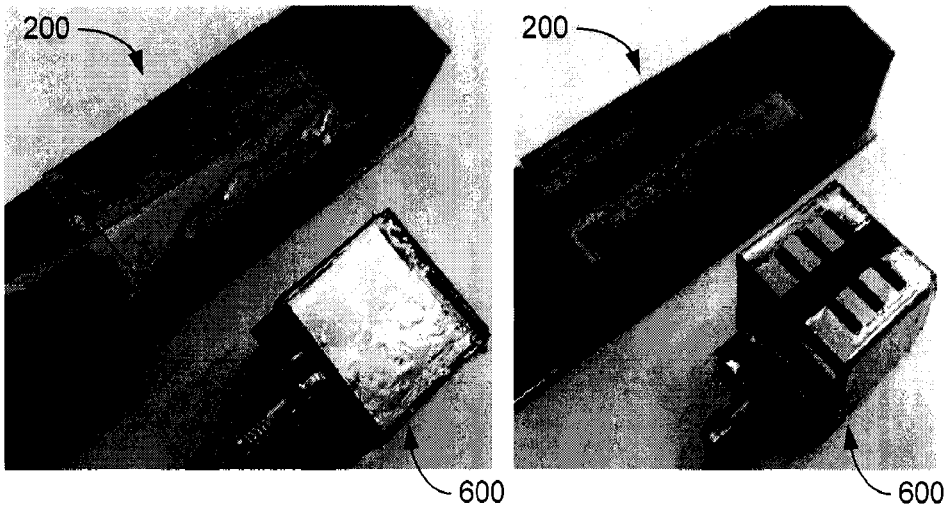

Referring to FIG. 10, shown is the folded patch antenna 600 as fabricated based upon the simulation dimensions. Rogers RT/Duroid 5870 was used as the substrate 103 for fabrication, which has a relative permittivity of 2.33 and a thickness of 31 mil. The size difference between the folded patch antenna designs is further illustrated in FIG. 11. The folded patch antenna 600 was measured on an HP 8719D network analyzer after a S11-1 port calibration. The measured result is included in the plot of FIG. 7 along with the simulation data for comparison. The measured resonance frequency was at 2.38 GHz with a S11 value of −29.3 dB. The small frequency shift between measurements may be a result of fabrication tolerance.

Since the area enclosed by the antenna is shielded by the ground plane, EMI protection may be provided by the antenna in the enclosed cavity. The ground plan may extend beyond the area of the patch to allow for overlap to fully enclose the cavity and maximize the EMI shielding. To demonstrate the self-package feature, the folded patch antenna 600 was loaded with a piece of PCB and measured again under the same conditions. With a PCB loading, the resonance frequency remained at 2.38 GHz and the measured S11 value was −28.8 dB, which is very close to −29.3 dB for the antenna 600 with an empty cavity. The compact antenna design may be used in devices such as biomedical wireless endoscopes, self-powered sensors, or other wireless controllers where omni-directional radiation pattern is desired.

Figure 12:
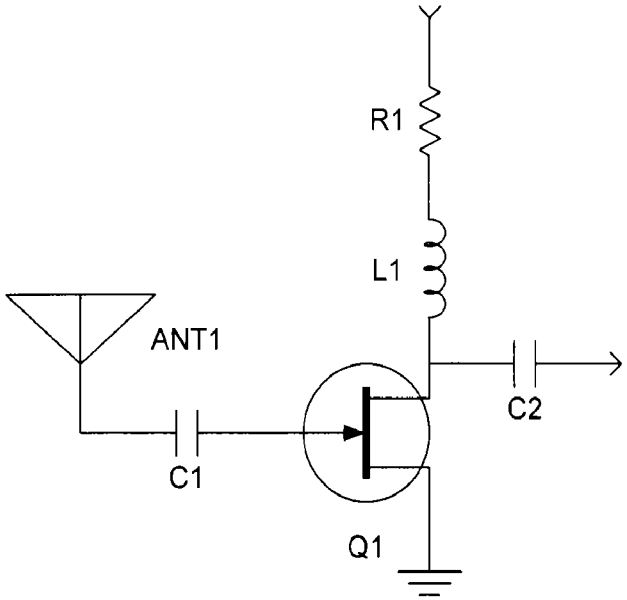
FIG. 12 is a circuit diagram of an example of an active antenna system for amplification of an antenna signal from a folded patch antenna in accordance with various embodiments of the present disclosures.

The reduced gain may be compensated for by including an amplifier in the enclosed cavity of the folded antenna. Referring to FIG. 12, shown is a circuit diagram illustrating an example of an active antenna system for amplification of the antenna signal. NBB-400 (RFMD Inc.) is a broadband gain block working from DC to 8 GHz with a nominal gain of 16 dB. In the example of FIG. 12, L1 is a broadband RF choke from ADCH-80A (Minicircuits Inc.); R1 is a 22 Ohm resistor; and C1 and C2 are 4.2 μF DC blocking capacitors. The amplifier circuit was placed in the cavity of the folded patch antenna 600 with the gate of the amplifier is connected with the antenna through a DC decoupling capacitor C1. A +5V bias signal may be applied to DC bias the amplifier. To test the active folded patch antenna configuration of FIG. 12, a standard patch 2.4 GHz antenna was used as a transmitting antenna.

Figure 13:
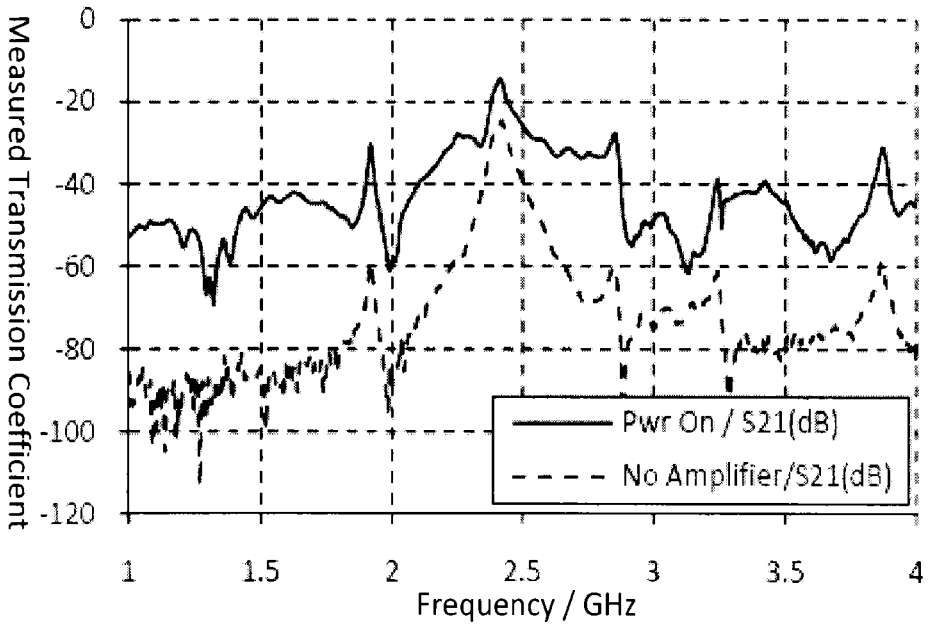
FIG. 13 is a representation of measurement results for the folded patch antenna of FIG. 6 with and without the active antenna system of FIG. 12 in accordance with various embodiments of the present disclosures.

The folded patch antenna was first tested without the amplifier and no amplification was observed. As shown in FIG. 13, the received power level measured at 2.4 GHz was −25.5 dB. Power was then applied to the amplifier integrated inside the folded patch antenna 600 and the received power level measured at 2.4 GHz was −17.9 dB. The power difference was about 7.6 dB, which can be attributed to the integrated amplifier. It can be seen that after turning on the amplifier, the center frequency of the folded patch antenna 600 remained at 2.4 GHz.

The size of a patch antenna may also be reduced using a complimentary split ring resonator (CSRR), which is a kind of metamaterial unit element that can offer negative permittivity, allowing for a reduction in patch size. In this case, a CSRR will force the electromagnetic field to reconfigure at a certain frequency, thus reducing the physical dimensions of the patch antenna. A compact folded patch antenna including three dimensional (3-D) non-planar folded CSRR loaded on the ground plane is described. By appropriately designing both the CSRR and the patch antenna, a significant size reduction may be achieved.

Figure 14:
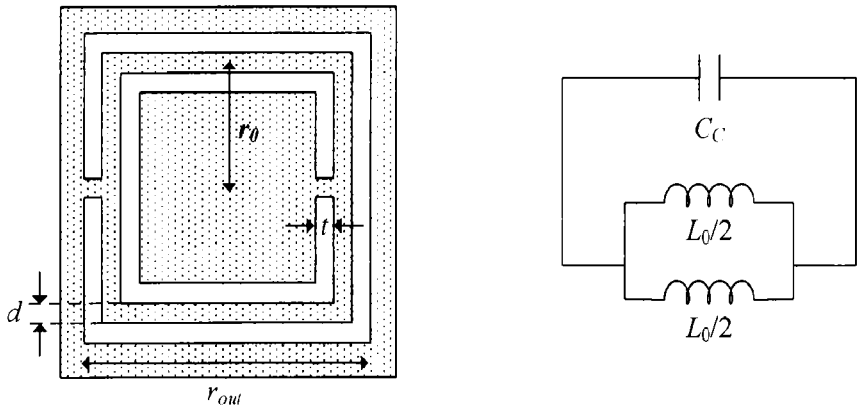
FIG. 14 is a graphical representation of an example of a complimentary split ring resonator (CSRR) in accordance with various embodiments of the present disclosures.

Metamaterial structures include split ring resonators (SRR), which can include two or more homocentric metallic rings with a capacitive slot on each ring. The SRR behaves like a LC resonator which interacts with external magnetic flux and gives equivalent negative permeability at a certain frequency. CSRR is a complimentary version of SRR. Instead of metallic rings, it is fabricated by etching away the SRR pattern in a metallic plane (e.g., the ground plane). In contrast to the SRR, the CSRR responds to axial electric field excitations and offers negative equivalent permittivity. CSRR resonance frequency is given by:

$$f = \frac{1}{2\pi\sqrt{L_c C_c}} \quad \text{EQN. 3}$$

due to duality, $L_C$ and $C_C$ can be found from the corresponding SSR by:

$$C_C = 4(\epsilon_0/\mu_0)L_S \quad \text{EQN. 4}$$

$$C_0 = 4(\epsilon_0/\mu_0)L_0 \quad \text{EQN. 5}$$

where $C_C = 2\pi r_0 C_{pul}$ as shown in the example of FIG. 14, $r_0$ is the average radius of the CSRR rings; $C_{pul}$ is the per unit length capacitance between the rings; $L_S$ can be approximated by that of a single ring with an averaged radius and width; and $L_c=L_0/4$ as shown in the equivalent circuit of FIG. 14.

Figure 15A:
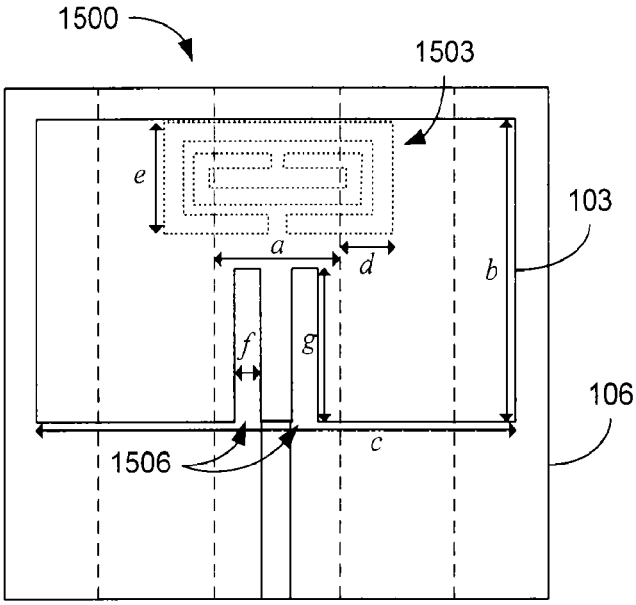
FIGS. 15A and 15B are graphical representations of another example of a folded patch antenna including the CSRR of FIG. 14 in accordance with various embodiments of the present disclosures.
Figure 15B:
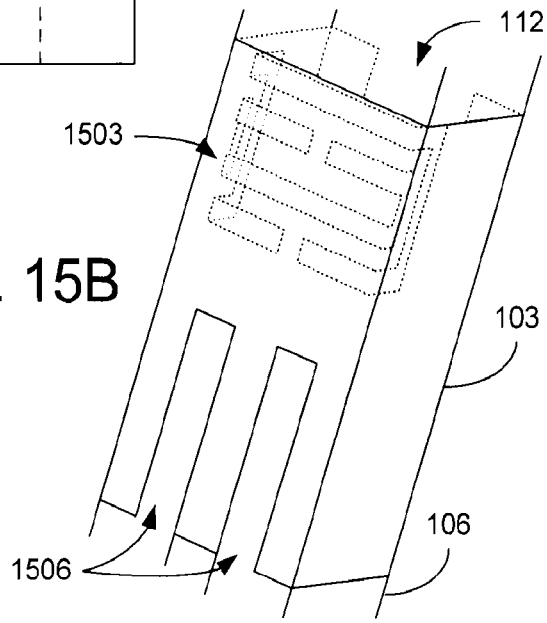

Based on EQNS. 3-5, on a substrate with a relative permittivity of 2.33 and a thickness of 31 mil, to have a CSRR resonance at 2.4 GHz, a radius of the outer ring $r_{out}$=7.5 mm, the distance between traces d=1 mm, and the trace width t=1 mm. Referring to FIGS. 15A and 15B, shown is an example of a folded patch antenna 1500 including a CSRR 1503. The CSRR 1503 is placed by the edge of the ground plane opposite the patch 103. The dimensions of the embodiment of FIGS. 15A and 15B are a=15 mm, b=20 mm, c=35.2 mm, d=3.2 mm, e=7.3 mm, f=2 mm, and g=11 mm. When the patch antenna is folded, the CSRR 1503 is also folded in the 3D non-planar shape.

The CSRR structure 1503 effectively reconfigures the electromagnetic field of the patch antenna, reducing the vertical length to about 50% of its original size, which is 20 mm on the same substrate. Meanwhile, the cross-sectional area has been also reduced to 15 mm×15 mm. The patch 103 does not cover all around the surface of folded antenna. A tuning gap 112 with a size of 5 mm×15 mm and two tuning slots 1506 on the patch with dimensions of 2 mm×11 mm are included for input impedance tuning of the folded patch antenna 1500.

Numerical simulation was performed using HFSS (Ansys Inc.). The CSRR loaded folded patch antenna 1500 was simulated using the dimensions of FIGS. 15A and 15B. Note that the CSRR 1503 is placed at the edge of the folded patch 103 on the ground plane in the cavity and that the CSRR 1503 is also folded in the 3D non-planar shape. The results demonstrate that, while the CSRR is not a planar structure, it still exhibits resonance behavior forcing the electromagnetic fields to reconfigure as in a planar configuration.

Figure 16:
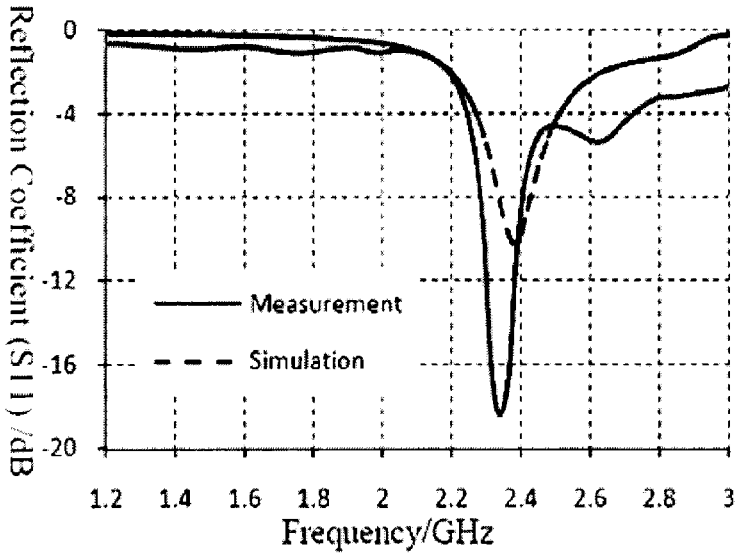
FIGS. 16, 17A, and 17B are representations of simulation and measurement results for the folded patch antenna of FIGS. 15A and 15B in accordance with various embodiments of the present disclosures.
Figure 17A:
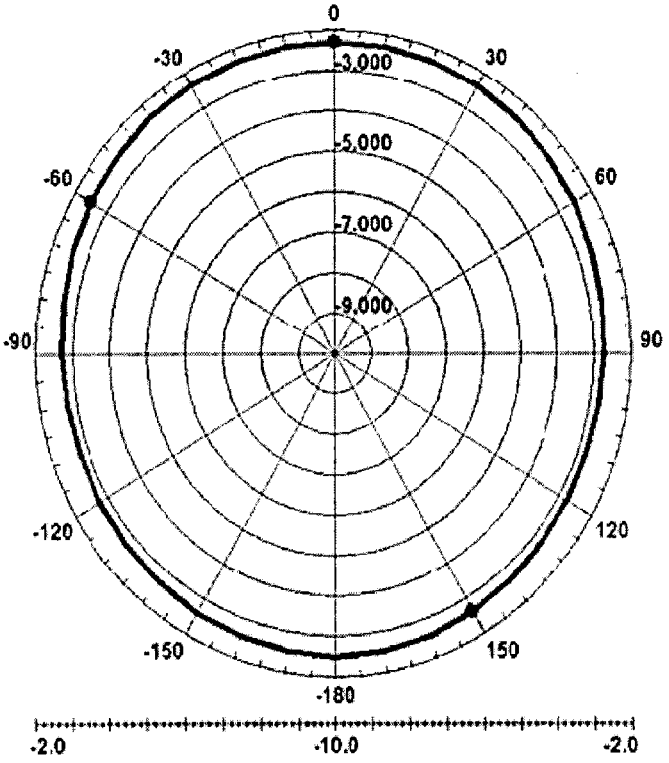
Figure 17B:
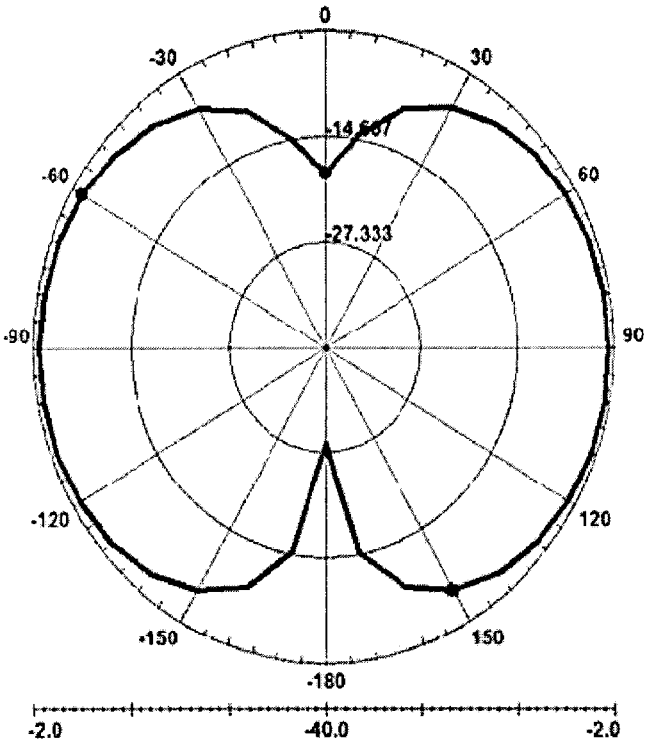

The outer ring of the CSRR 1503 has both a trace width and a distance between traces of 1 mm. The edge of the CSRR 1503 is aligned with the upper edge of the patch 103. The simulated S-parameter and radiation patterns are shown in FIGS. 16, 17A, and 17B, respectively. As seen in FIG. 16, the antenna radiates at 2.4 GHz with a maximum return loss (S11) of −10.27 dB and a maximum realized gain of 0.1 dB toward x-F direction. FIGS. 17A and 17B illustrate that the folded patch antenna 1500 offers a nearly omni-directional radiation pattern, while the maximum directivity is as low as 0.2 dBi. The radiation efficiency was 60%. With tuning, the folded patch antenna 1500 radiates at the same center frequency the folded patch antenna 1200 without a CSRR 1503, while the volume is reduced by about 72%. The folded patch antenna 1500 with the CSRR 1503 also has a quasi-omni-directional radiation pattern which is desirable in many applications such as biomedical systems and compact sensors, while it provides an EMI shielded cavity that is useful for installation of electronics.

Figure 18:
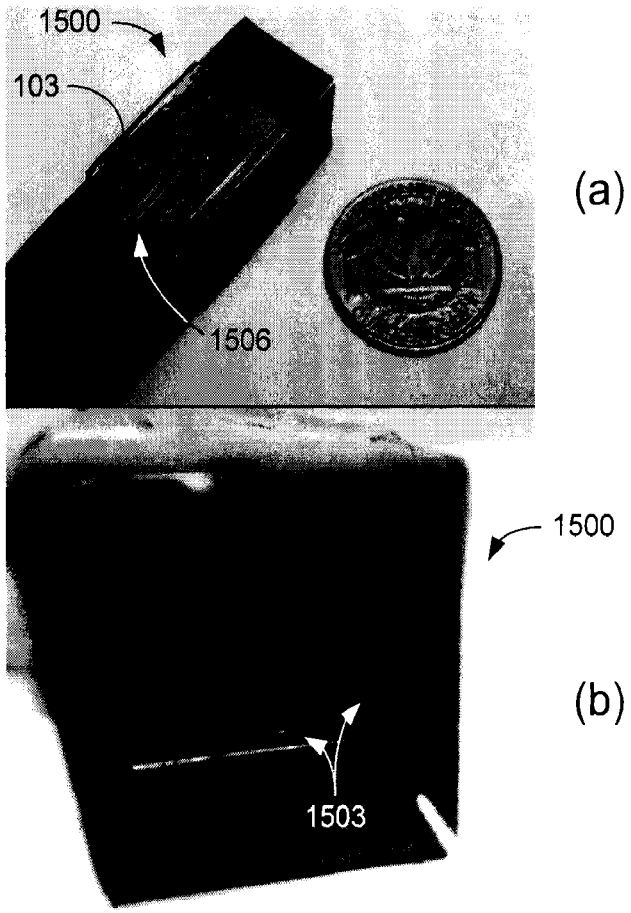
FIGS. 18(*a*) and 18(*b*) include images of the folded patch antennas of FIGS. 15A and 15B in accordance with various embodiments of the present disclosures.

The folded patch antenna 1500 with the CSRR 1503 was fabricated on Rogers RT/Duroid 5870 with a relative permittivity of 2.33 and a thickness of 31 mil using a milling machine. Since the patch 103 and the CSRR 1503 are on different sides of the PCB, a double layer fabrication process was used with consideration for the alignment of the CSRR 1503 with the edge of the patch 103. Views of the (a) front and (b) end of the fabricated folded patch antenna 1500 are shown in FIG. 18. As can be seen in the end view of FIG. 18(*b*), the CSRR 1503 is located inside the cavity of the folded patch antenna 1500 and is folded into a non-planar shape.

Measurements were performed on an HP8719D network analyzer after an S11-1 port calibration. The measured results are compared with simulation ones in FIG. 16. The measurement data shows a radiation frequency at 2.36 GHz with a S11 value of −18.4 dB. There was a frequency shift which may be attributed to the misalignment of the CSRR 1503 during fabrication.

While the folded patch antennas have been discussed with respect to a rectangular shape, other shapes may also be possible. For example, cylindrical or spiral shapes including polygonal shapes may be possible using a more flexible dielectric. Such shapes can provide advantages in applications such as wireless endoscopes for gastro-intestinal monitoring. Here a folded patch antenna with CSRR loading is designed on a flexible substrate of RT/Duroid 5880 (Rogers Inc.) with a dielectric thickness of 10 mil (0.254 mm), a clad copper thickness of 17 mm, a dielectric constant of 2.2, and a loss tangent of 0.0009. By accommodating the flexible substrate, the folded shape can be much more diversified. In addition, the CSRR structure is patterned in the patch 103 to reduce the size of the antenna. Because of the folded architecture, the resultant CSRR is in a nonplanar shape. Its design and analysis was performed using circuit modeling and HFSS (Ansys Inc.).

Figure 19:
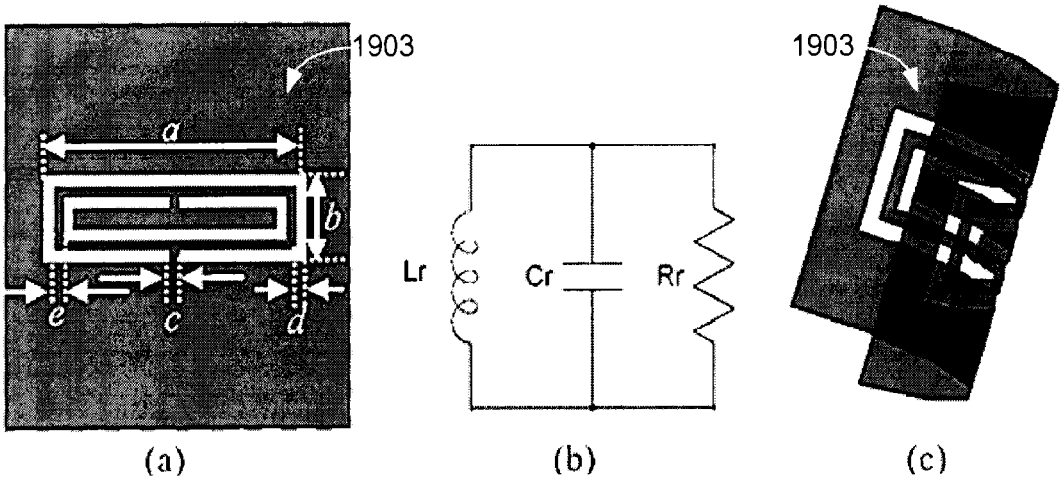
FIG. 19(*a*), 19(*b*), and 19(*c*) include graphical representations of another example of a CSRR in accordance with various embodiments of the present disclosures.

Referring to FIG. 19, shown are graphical representations of a complementary split-ring resonator (CSRR) that may be patterned in the patch 103 of the antenna. FIG. 19 illustrates (a) a schematic diagram of a CSRR 1903, (b) an equivalent circuit diagram where the CSRR is modeled as a parallel L-C tank circuit, and (c) a depiction of the folded CSRR 1903. The resonance frequency f of the CSRR can be determined by EQN. 3, where $L_r=L_C$ and $C_r=C_C$ are the equivalent inductance and capacitance of the CSRR, respectively. $R_r$ accounts for both dielectric and conductor losses. A numerical analysis tool can be used for precise CSRR design. For example, dimensions of a=13 mm, b=4 mm, and c=d=e=0.5 mm can be used. The extracted equivalent lumped element values of the CSRR 1903 are then $L_r$=2.25 nH, $C_r$=3.35 pF, and $R_r$=1050 Ohms. The resonant frequency of the planar CSRR 190 of FIG. 19(*a*) is 1.81 GHz, and that of the folded CSRR 190 of FIG. 19(*c*) is 1.84 GHz. The same dimensions of this CSRR 1903 were used for the 2.4-GHz CSRR loaded patch. Note that to compensate for mutual coupling between the CSRR 1903 and the patch 103, a resonant frequency of 1.81 GHz for the CSRR 1903 was used for the desired antenna radiation frequency of 2.4 GHz. By implementing the CSRR on the patch instead of the ground plane, leakage through the ground plane can be reduced or eliminated.

Figure 20:
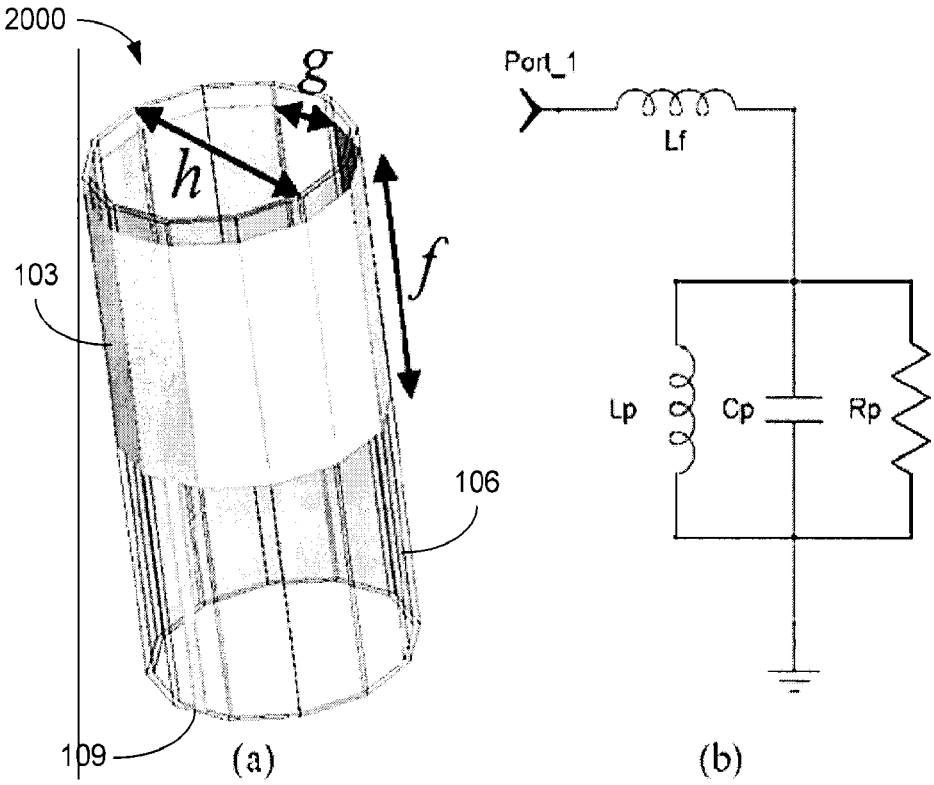
FIGS. 20(*a*), 20(*b*), 21(*a*), and 21(*b*) are graphical representations of other examples of folded patch antennas in accordance with various embodiments of the present disclosures.

Referring to FIG. 20, shown is an example of (a) a patch antenna 2000 without a CSRR 1903 folded into a nearly cylindrical shape with dimensions of, f=10.50 mm, g=2.88 mm, and h=10.00 mm and (b) the equivalent circuit diagram modeling the folded patch antenna 2000 as an RLC resonator tank. For example, the folded patch antenna of FIG. 20 is illustrated as a 12-sided polygon that is folded together to provide the cylindrical shape. As used herein, cylindrical patch antennas include multisided polygonal shapes that when folded together form a structure approximating a cylinder as well as structures that when rolled up (or wrapped) for a cylindrical structure. The equivalent lumped element values of the cylindrical folded patch antenna 2000 are $L_f$=0.4 nH, $L_P$=0.012 nH, $C_P$=25.32 pF, and $R_P$=33.27 Ohms. $L_f$ stands for the inductance value of the feeding line 109, and the resonance tank represents the patch 103. It should be noted that after folding, there is a tuning gap 112 between the two edges of the patch 103 on the side opposite the feeding line 109. The tuning gap 112 can be used for impedance matching to remove the need for an external matching circuit. HFSS simulation of the cylindrical folded patch antenna 2000 shows a resonance frequency of 9.16 GHz. The equivalent circuit of FIG. 20(*b*) presents a resonance frequency of 9.155 GHz.

Figure 21:
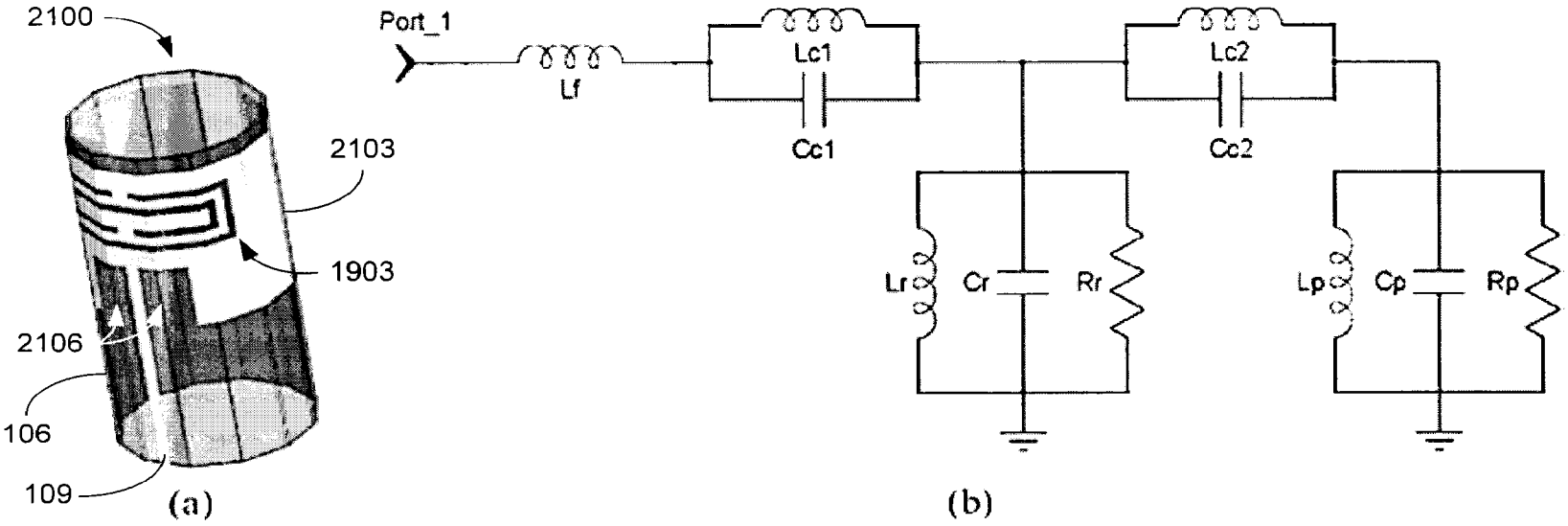

The resonance frequency of the folded patch antenna 2000 without a CSRR 1903 is much higher than the targeted frequency of 2.4 GHz. To shift down the resonance frequency of the patch antenna 2000 from 9.16 to 2.4 GHz, the CSRR 1903 with a resonance frequency of 1.81 GHz is patterned in the patch 103. Referring now to FIG. 21, shown is (a) the resulting SCRR loaded patch antenna 2100 with a resonance frequency of 2.4 GHz, and (b) the equivalent circuit model of the CSRR loaded patch 2103, where the CSRR 1903 is modeled as another tank circuit. The coupling between the CSRR 1903 and other microstrip components including the patch 103 and feeding line 109 are represented with capacitive and inductive parameters and modeled as tanks. The extracted lumped element values are, e.g., $L_{c1}$=4.57 nH, $C_{c1}$=1.35 pF, $L_{c2}$=1.08 nH, $C_{c2}$=2.19 pF, $L_r$=2.25 nH, $C_r$=3.35 pF, $R_r$=1050 Ohms, $L_P$=0.012 nH, $C_P$=25.32 pF, and $R_P$=33.27 Ohms. By inserting the CSRR structure on the patch, the resonant radiation frequency of the CSRR resonator, which can be much lower than the original radiation frequency of the patch, becomes an additional radiation frequency.

The folded patch antenna 2100 shown in FIG. 21(*a*) is a combination of the CSRR 1903 of FIG. 19(*a*) and the cylindrical patch antenna 2000 of FIG. 20(*a*) with the same dimensional parameters except that two additional matching slots 2106 at the base of the patch 2103 that have a size of 2.99×4 $mm^2$. The CSRR 9103 is patterned on the top portion of the patch 2103. The overall system is represented in FIG. 21(*b*) with two resonator tanks (one from the patch and the other from CSRR) connected by couplings, and the whole system radiates at a balanced frequency of 2.4 GHz. The antenna length is 10.5 mm (0.11λ at 2.4 GHz) on the substrate used. This corresponds to a size reduction of about 74% compared to its traditional patch counterpart without CSRR loading. The simulated antenna has a front-to-back ratio as low as 0.5 dB, which indicates a quasi-omnidirectional pattern. Since the folded patch antenna 2100 is electrically small, it shows a relatively low gain of 5.2 dB. The antenna radiation efficiency is 21.

Figure 22:
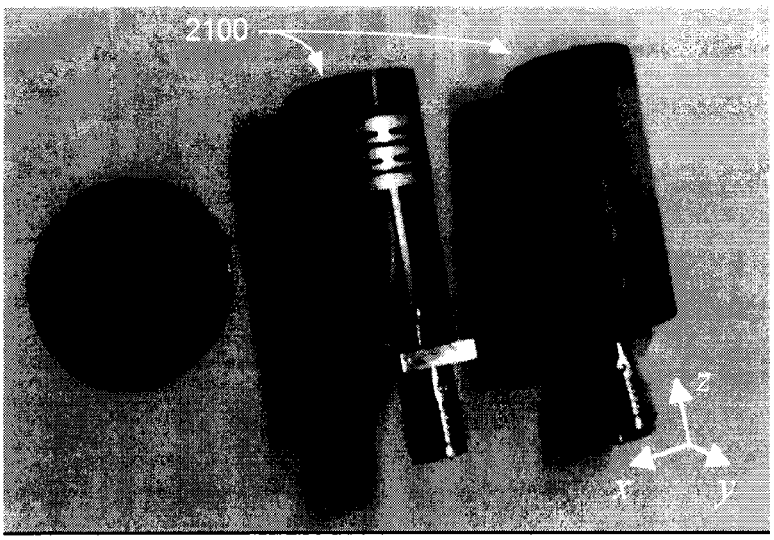
FIG. 22 is an image of the folded patch antenna of FIG. 21 in accordance with various embodiments of the present disclosures.
Figure 23:
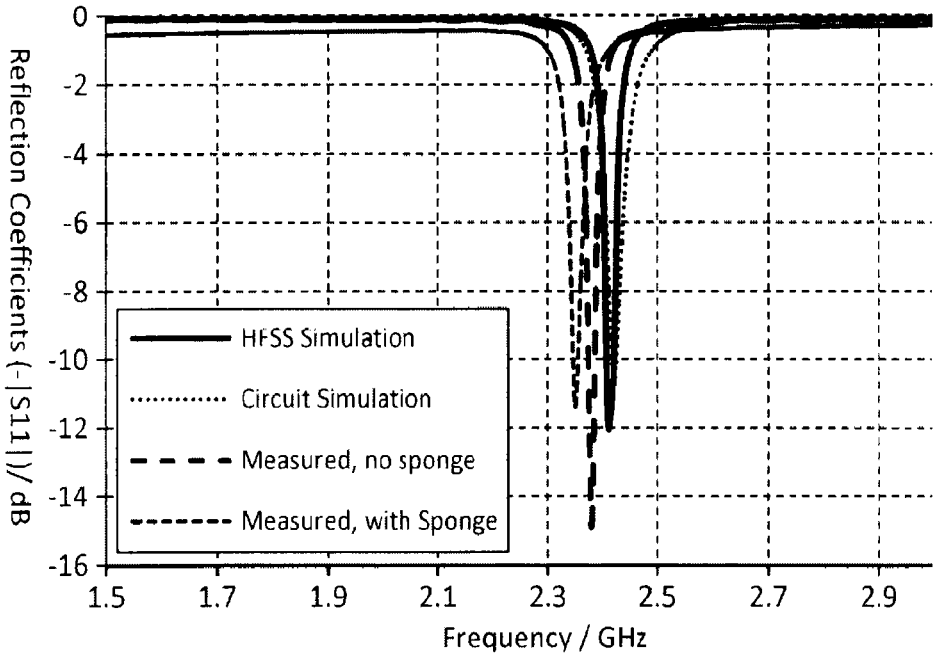
FIGS. 23, 24(*a*), 24(*b*), and 25 are representations of simulation and measurement results for the folded patch antenna of FIG. 21 in accordance with various embodiments of the present disclosures.

The folded patch antenna 2100 was fabricated using a LPKF milling machine S100 on a planar substrate, which was rolled up (or wrapped) to form a cylindrical shape as shown in FIG. 22. Measurement were performed using an Agilent E5071C VNA between 1 and 3 GHz after short-open-load-thru (SOLD calibration. Referring to FIG. 23, shown are the plotted measurement and simulation results. They show good agreement within approximately 1% tolerance.

Figure 24:
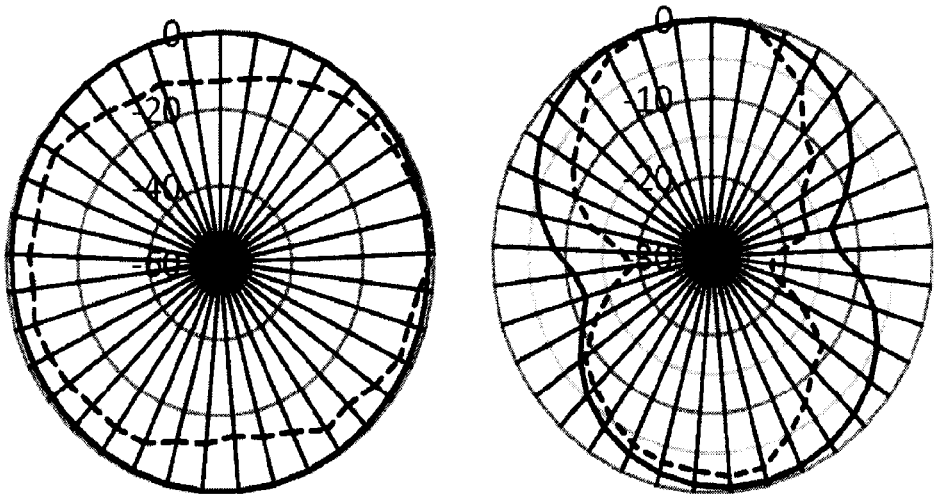

HFSS and circuit simulation show a return loss ($-|S_{11}|$) of 11.7 and 10.7 dB at 2.4 GHz, respectively, while the measured one has 15 dB at 2.38 GHz. The slight frequency shift may be attributed in part to the fabrication imperfection associated with the milling machine resolution. FIG. 24 shows the measured (dashed curves) and simulated (solid curve) radiation patterns on (a) the x-z plane and (b) the x-y plane, where good omnidirectionality can be observed. Measurements were also taken with a sponge (with a dimension of 75×75×50 $mm^3$) that was damped with 30 mL water wrapped around the antenna under test. The damped sponge was to mimic the lossy human body environment where a wireless endoscope would operate.

Testing was carried out with the fabricated antenna mounted on a CC2510 development transmitter kit from Texas Instruments, Inc. and a monopole antenna (B4844-01, Antenova, Inc.) used as the transmitting antenna.

Figure 25:
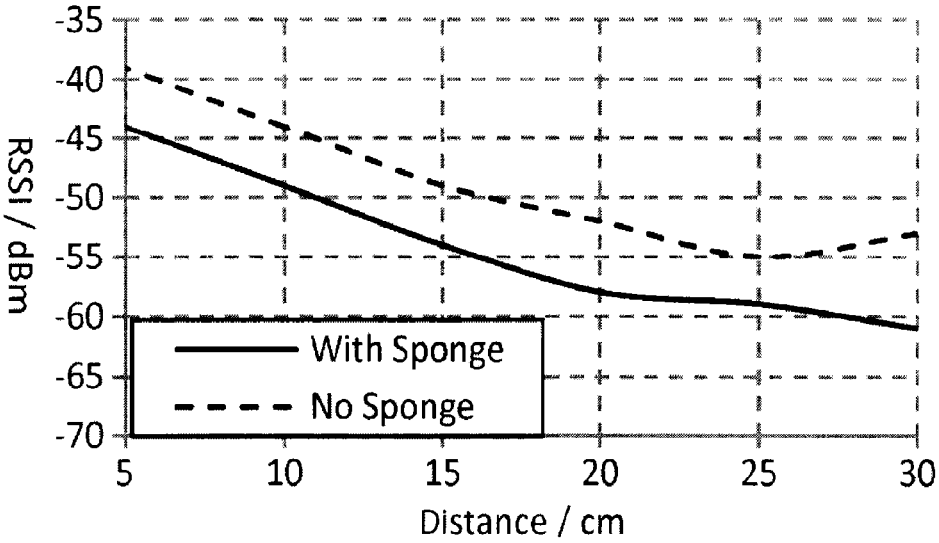

The cylindrical folded patch antenna 2100 was tested with and without the damped sponge covering the antenna. The CC2510 was programmed to evaluate the received signal strength by received signal strength indication (RSSI), which is defined as:

$$\text{RSSI(dBm)}=-(10n\log_{10}d+A) \qquad \text{EQN. 6}$$

where n is the signal propagation constant, d is the distance from the transmitter in meters, and A is the received signal strength at a distance of one meter in dBm. A high RSSI value indicates a good received power level. As shown in FIG. 25, RSSI with a wet sponge is always lower than that of the bare antenna under test. This may be attributed to RF power absorption in the wet environment.

A folded patch antenna 2100 with CSRR loading fabricated on a flexible substrate was configured in a cylindrical shape for use in, e.g., a wireless capsule endoscope application. The folded patch antenna 2100 serves as an electromagnetic radiator and may act as a packaging layer surrounding and protecting electronics within the folded antenna. As such, it may be referred to as a "self-packaged antenna." By maintaining the integrity of the ground plane, the folded patch antenna 2100 has no electromagnetic leakage toward the enclosed area. High-speed digital circuits and EMI susceptible analog circuits can be loaded inside the antenna with minimal interference. By tuning the matching impedance, the antenna does not need external matching circuits and offers an omnidirectional radiation pattern and EMI shielding to the system. The large enclosed space may be used for housing digital controllers, EMI sensitive sensors, cameras, batteries, or drug delivery systems in the device.

Other forms of folded patch antennas may also be possible for reducing the size of the antenna. For example, a compact patch antenna with multiple inductive notches may be fabricated on a flexible substrate and wrapped into a cylindrical shape for use in, e.g., wireless capsule endoscope applications. A multi-notch folded patch antenna with a radiation frequency of 433 MHz using a thin liquid crystal polymer substrate is examined. An omnidirectional radiation pattern may be obtained by wrapping multi-notch folded patch antenna into the cylindrical shape.

Figure 26:
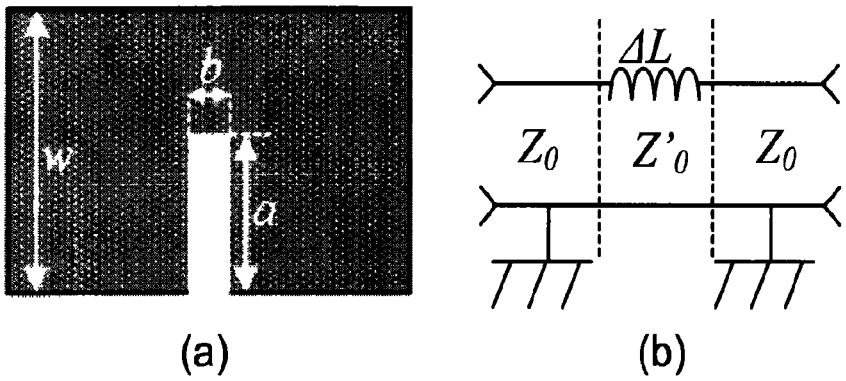
FIGS. 26(*a*) and 26(*b*) include graphical representations of modeling a notch in a microstrip in accordance with various embodiments of the present disclosures.

Slits or notches loaded on a microstrip component can be analyzed by the method of perturbation. A notch leads to a localized concentration of magnetic field, which can be treated as an inductive loading. Referring to FIG. 26, shown is (a) a view of a notch and (b) an equivalent circuit modeling the notch. Since the microstrip width w changes at the notch, a characteristic impedance variation takes place from $Z_0$ to $Z'_0$ as modeled in the equivalent circuit. The equivalent inductance for each notch can be calculated from:

$$\Delta L=\frac{\mu_0\cdot\pi\cdot h}{2}\times\left(1-\frac{Z_0}{Z'_0}\right)^2 \qquad \text{EQN. 7}$$

where $\mu_0$ is the permeability of free space and h is the thickness of the substrate. It should be noted that the equivalent inductance introduced by the notch is independent of the substrate permittivity.

Figure 27:
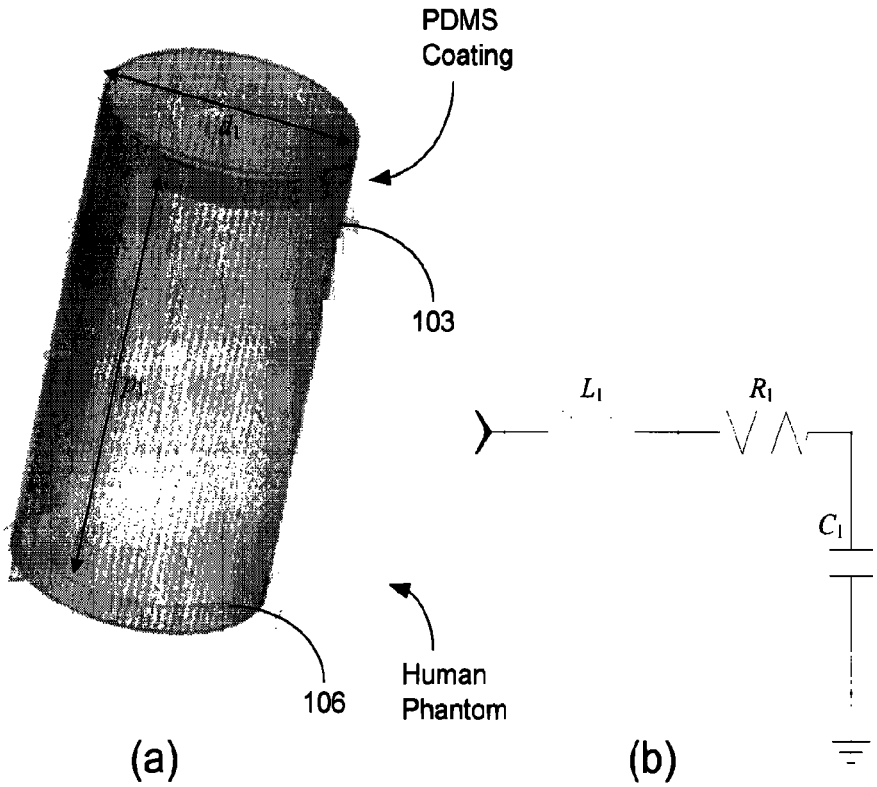
FIGS. 27(*a*), 27(*b*), 28(*a*), 28(*b*), and 28(*c*) include graphical representations of other examples of folded patch antennas in accordance with various embodiments of the present disclosures.

A multi-notch patch antenna fabricated on a flexible substrate can be wrapped (or folded) into a cylindrical capsule shape. For example, the antenna may be disposed on a liquid crystalline polymer (LCP) based flexible substrate with a thickness of 4 mil (0.1 mm) and a dielectric constant of 2.9. The multi-notch patch antenna may be designed using HFSS (Ansys Inc.) and modeled as a LC tank; a resistance R is also included in the model which reflects all the associated losses. To design a 433 MHz patch antenna with inductive loading, we begin with a patch 103 that has no notch loading as shown in FIG. 27. A human body phantom may be used as the surrounding environment (with a dielectric constant of 58.0) to simulate conditions for biomedical applications such as wireless endoscopes for gastro-intestinal monitoring.

The cylindrical dimensions were designed to be comparable with commercially available wireless endoscope capsules, e.g., with a patch width of 22 mm and a capsule diameter of 12 mm. As illustrated in FIG. 27, a polydimethylsiloxane (PDMS) layer with a thickness of 1 mm can be coated on the surface of the folded patch antenna. Note that PDMS is optically transparent to visible light and bio compatible. The transparent PDMS allows for a camera to be integrated the folded patch antenna to record images for transmission out of the body. As shown in FIG. 27(*b*), the folded patch antenna may be modeled as an LC resonance tank whose resonance frequency can be determined by:

$$f_r = \frac{1}{2\pi\sqrt{L_1 C_1}} \qquad \text{EQN. 8}$$

where $R_1$ is the resonance resistance of the resonator.

Figure 28:
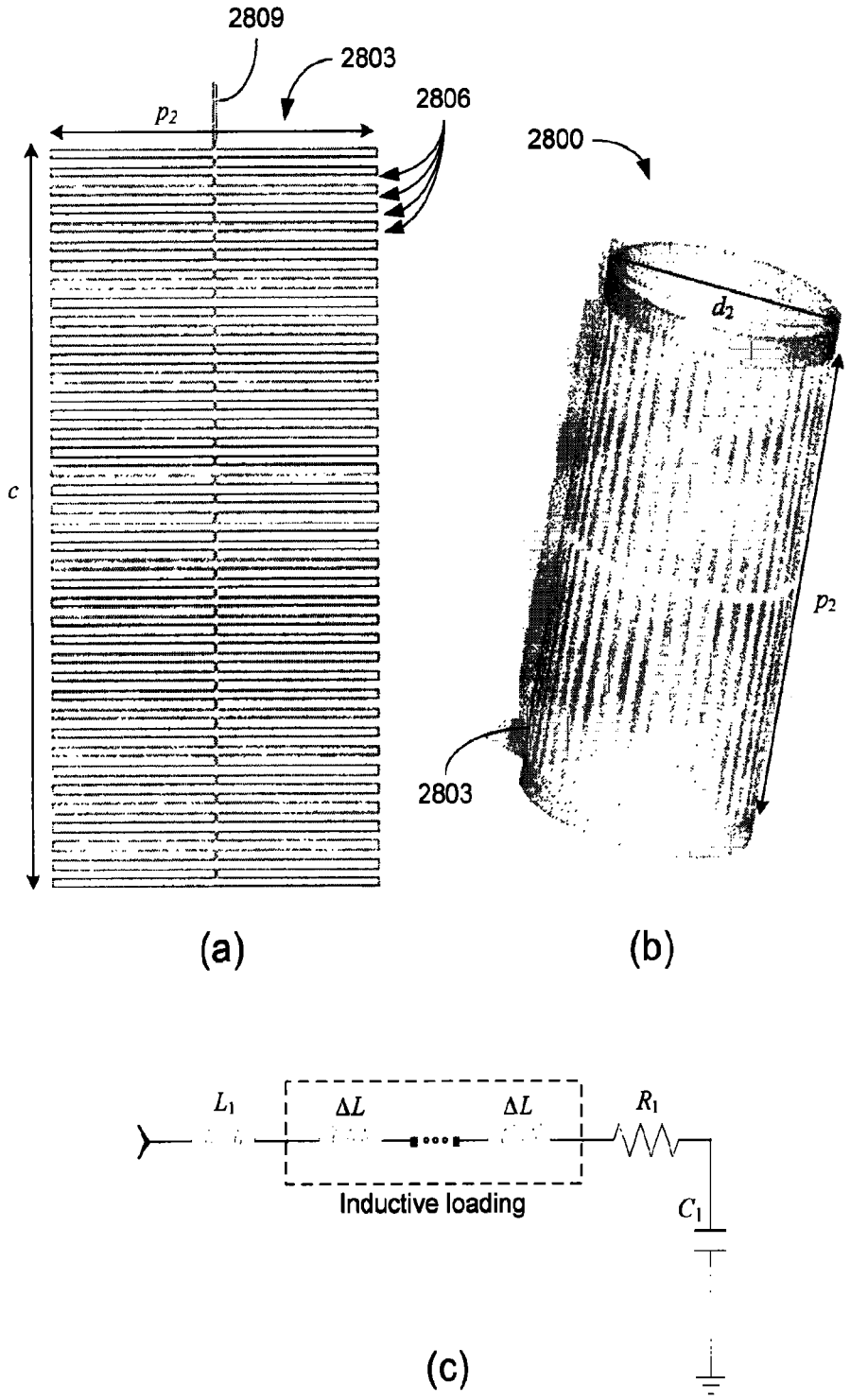

According to HFSS and equivalent circuit model simulation, the folded patch antenna radiates in resonance at 1.38 GHz, which is much higher than the targeted frequency of 433 MHz. From EQN. 8, it can be seen that to lower the resonance frequency, proper inductive or capacitive loading can be used. Since capacitive loading usually needs additional components which can take up extra area, this solution is not preferred for the wireless endoscope applications. Referring to FIG. 28, multiple notches 2806 (each notch with a dimension of 10.8 mm by 0.47 mm) are inserted for inductive loading. FIG. 28 depicts (a) a fit patch antenna with multiple notches, (b) the folded or wrapped patch antenna 2800, and (c) an equivalent circuit of the wrapped patch antenna 2800 with inductive loading. According to EQN. 7, the inductance of each pair of notches 2806 is 0.1 nH. To bring the resonance frequency of the folded patch antenna in FIG. 27(*a*) down to 433 MHz, 39 pairs of such notches 2806 are loaded on the patch 2803. It should be noted that although the notch loading also reduces the capacitance value, the increase in inductance is much more significant. The dimensions of the inductively loaded patch are, e.g., $d_2$=12 mm, $p_2$=22 mm, c=37.6 mm, with a notch size of 0.47 mm by 10.8 mm. The folded or wrapped patch antenna 2800 shown in FIG. 28(*b*) can be modeled as a LC tank with loading a series of inductors (ΔL). The equivalent circuit model is shown in FIG. 28(*c*), with the equivalent lumped element values being $L_2$=0.04 nH, $C_2$=45.7 pF, ΔL=0.1 nH, and $R_2$=72.5 Ohms.

Figure 29:
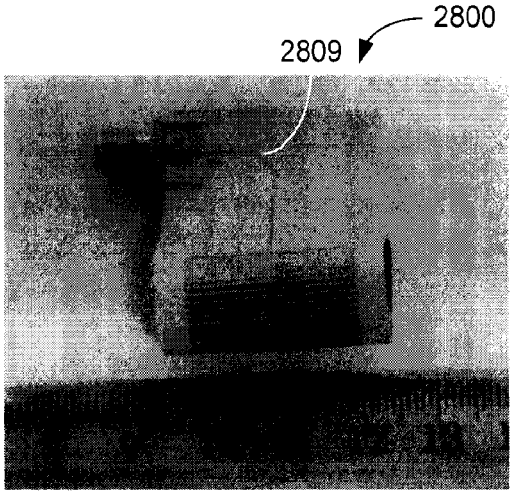
FIGS. 29(*a*) and 29(*b*) include images of the folded patch antenna of FIG. 28 in accordance with various embodiments of the present disclosures.
Figure 29:
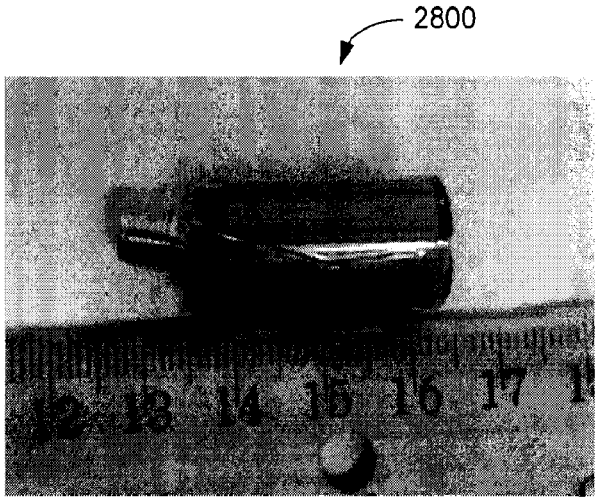

The wrapped patch antenna 2800 was then fabricated on the flexible substrate using a S100 milling machine from LPKF Inc. The fabricated antenna 2800 is shown in FIG. 29 (*a*) before PDMS coating and (b) after PDMS coating. The PDMS coating seals the device in its cylindrical configuration and provides protection to any electronics included in the cavity of the folded or wrapped patch antenna 2800. As shown in FIG. 29(*a*), the feeding line 2809 is wrapped inside the cylinder cavity. The SMA connector was included for testing purposes. The fabricated patch antenna 2800 was tested in a human phantom for the 433 MHz band and the composition is shown in TABLE 1.

TABLE 1

Composition of body phantom.

| Item | Percentage by weight |
|---|---|
| Deionized water | 51.16 |
| Sodium Chloride | 1.49 |
| Sugar | 46.78 |
| Bactericide | 0.05 |
| Hydroxyethyl Cellulose | 0.52 |

Measurements were performed using an E5071C vector network analyzer after one port calibration. A bare antenna, the PDMS coated version in air, and the PDMS coated antenna in the phantom solution were tested.

Figure 30A:
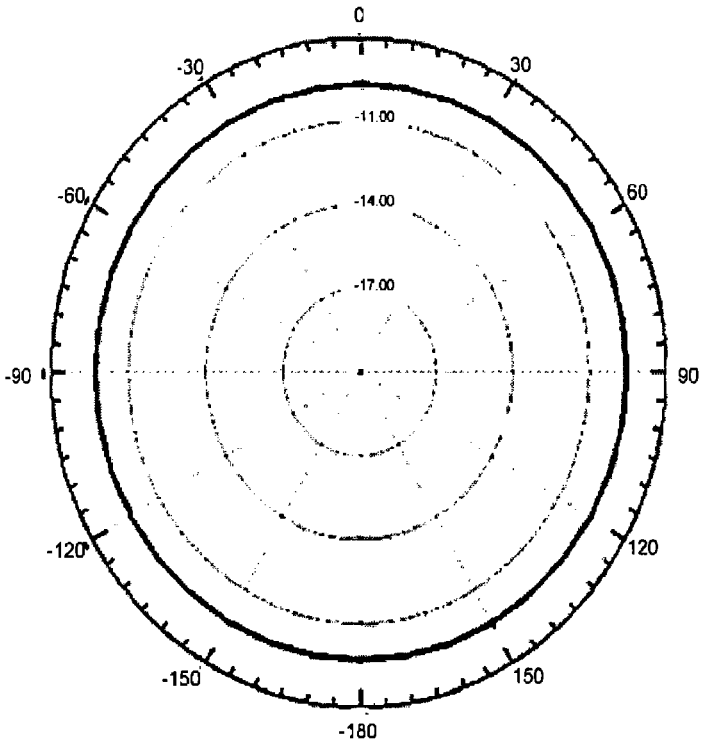
FIGS. 30A, 30B, and 31 are representations of simulation and measurement results for the folded patch antenna of FIG. 28 in accordance with various embodiments of the present disclosures.
Figure 30B:
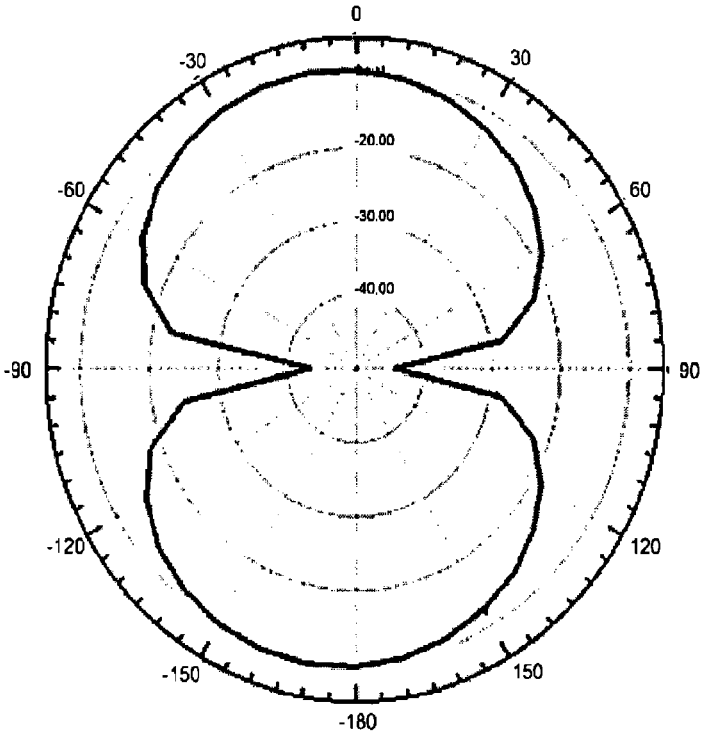

Referring to FIGS. 30A and 30B, show are the radiation patterns in the x-y plane and in the x-z plane, respectively. As can be seen, an omnidirectional radiation pattern has been obtained. With inductive loading, the patch length is approximately $0.08\lambda_g$ where $\lambda_g$ is the guided wavelength on the substrate. The antenna gain is relatively low at −9.6 dB. However, by using a transceiver with a sensitivity of, e.g., −110 dBm, this antenna gain is still acceptable.

Figure 31:
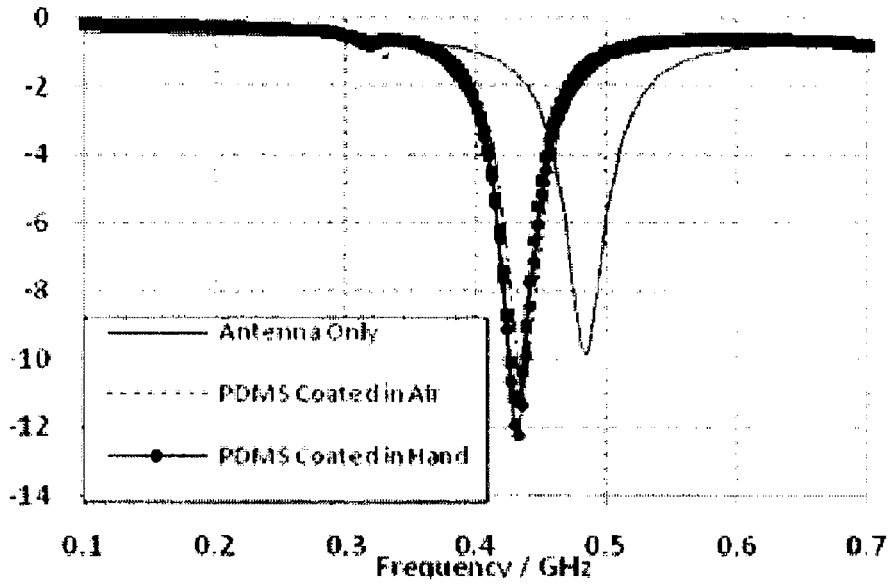

As illustrated in FIG. 31, the bare patch antenna 2800 radiates at 482 MHz while the PDMS coated patch antenna 2800 radiates at 436 MHz. In the human phantom solution, the wrapped patch antenna 2800 shows radiation at 430 MHz with a peak return loss of −12.3 dB. The frequency shift from designed 433 MHz to 430 MHz may be mainly due to fabrication tolerance of the antenna. When the wrapped patch antenna 2800 was grabbed by a human hand, it exhibited nearly the same result as the wrapped patch antenna 2800 in the human phantom. It should be noted that no external matching circuit was used for the wrapped patch antenna 2800. The folded or wrapped patch antenna 2800 was designed including an inductively loaded patch on a flexible LCP based substrate, which can be wrapped into the desired capsule shape. This wrapped patch antenna 2800 is compact and exhibits an omnidirectional radiation pattern.

The flexible substrates of the folded patch antennas presented above may be extended to form a platform for mounting electronics that can work in conjunction with the folded patch antenna. For example, such a folded patch antenna platform may be used to develop a wireless telemetry system using flexible substrates for health monitoring and personal body area network applications. As a test vehicle, a wireless capsule endoscope can be implemented using the foldable electronics approach. The platform system can include, e.g., a wireless radio frequency (RF) transceiver, a microprocessor, a memory, one or more sensors, a camera and/or a drug delivery system that are communicatively coupled to preformed designed operations. For instance, the platform can include a chip camera such as an OVM7690 (Omnivision, Inc.). The sensors can be used to monitor multiple kinds of biomedical parameters such as, e.g., temperature, pressure, and/or blood oxygen saturation. The acquired data may be stored in memory by the microprocessor and/or transmitted to an external system by the transceiver.

Figure 32:
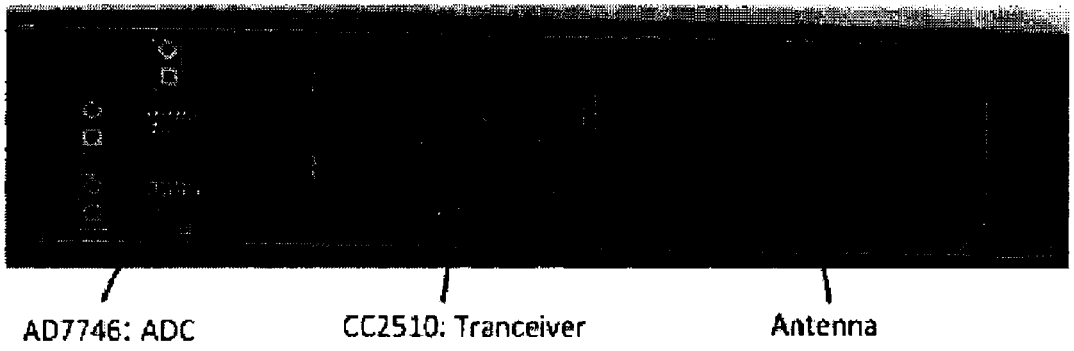
FIG. 32 is an image of a folded patch antenna platform in accordance with various embodiments of the present disclosures.

Referring to FIG. 32, shown is an example of a folded patch antenna platform in accordance with various embodiments of the present disclosure. The wireless electronics, sensor modules, and folded patch antenna can be fabricated on a common flexible substrate and rolled up into a cylindrical shape with the electronics in the cavity of the folded patch antenna. The electronic circuit modules and the patch antenna are fabricated on a flexible substrate such as a thin Liquid Crystalline Polymer (LCP) layer. The LCP based laminates can be thin (1 to 4 mil), flexible, and resistant to heat, water, and chemicals. A folded patch antenna using such a flexible substrate can be built in a circular cylindrical shape as shown in FIG. 29, which may be used in, e.g., endoscope applications. The folded patch antenna platform can include a transceiver and a controller for data acquisition and wireless communication with external systems. For example, a low power transceiver module such as a CC2510 and a microcontroller 8051 from Texas Instruments with an AD7746 from Analog Devices can be used to interface with multiple sensors. An external transceiver may communicate with the capsule through the folded patch antenna for control and data communications. The external transceiver and computer interface may be implemented using, e.g., a USB type controller. A graphic user interface (GUI) on the computer can facilitate data readout and easy control of the device operation. The folded patch antenna platform can be extended to other wearable biomedical applications such as, e.g., electrocardiogram (ECG), electroencephalogram (EEG), or dental monitoring systems.

Traces between components may be included in or on the flexible substrate to avoid the use of vias or interconnects. In this architecture, many vias and alignments between multiple substrates are eliminated. When wrapped, the capsule can be surrounded by the ground plane of the folded patch antenna to provide EMI shielding of the electronic components and modules. Since the flexible substrate is folded or wrapped, the components mounted on the substrate can be placed with alignment perpendicular to the wrapping or folding direction to reduce or eliminate mechanical stress. In addition, the patch antenna may be designed to minimize the mechanical stress on the antenna structure while also providing impedance matching. By configuring the folded patch antenna with impedance matching, the need for a matching circuit can be avoided allowing for smaller size and reduced cost. A power source such as, e.g., a battery or charged capacitor may also be included in the cavity of the folded patch antenna. The microcontroller can monitor the power source condition and initiate recharging if the power level falls below a predefined threshold using, e.g., wireless charging. The folded patch antenna platform may be encased in a biocompatible material such as, e.g., polydimethylsiloxane (PDMS) or parylene to seal the unit in the desired shape and protect the folded patch antenna and electronics in the device.

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

It should be noted that ratios, concentrations, amounts, and other numerical data may be expressed herein in a range format. It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a concentration range of "about 0.1% to about 5%" should be interpreted to include not only the explicitly recited concentration of about 0.1 wt % to about 5 wt %, but also include individual concentrations (e.g., 1%, 2%, 3%, and 4%) and the sub-ranges (e.g., 0.5%, 1.1%, 2.2%, 3.3%, and 4.4%) within the indicated range. The term "about" can include traditional rounding according to significant figures of numerical values. In addition, the phrase "about 'x' to 'y'" includes "about 'x' to about 'y'".

Therefore, at least the following is claimed:

1. A folded patch antenna, comprising:

a patch disposed on an outer side of a flexible substrate; and a ground plane disposed on an inner side of the flexible substrate opposite the patch, where the flexible substrate is folded to form an enclosed cavity defined by the inner side of the flexible substrate, and the patch is folded to form a folded patch on the outer side of the flexible substrate.

2. The folded patch antenna of claim 1, wherein opposite edges of the folded patch define a tuning gap on one side of the folded patch antenna.

3. The folded patch antenna of claim 2, further comprising a feeding line coupled to the patch on a side of the folded patch antenna that is opposite the tuning gap.

4. The folded patch antenna of claim 1, wherein the ground plane encircles the enclosed cavity.

5. The folded patch antenna of claim 1, further comprising a structure for tuning the frequency of the folded patch antenna.

6. The folded patch antenna of claim 5, wherein the structure comprises pairs of inductive slots on opposite edges of the patch, the inductive slots separated by a tuning gap defined by the opposite edges of the folded patch.

7. The folded patch antenna of claim 5, wherein the structure comprises a complimentary split ring resonator (CSRR).

8. The folded patch antenna of claim 7, wherein the CSRR is patterned in the ground plane.

9. The folded patch antenna of claim 7, wherein the CSRR is patterned in the patch.

10. The folded patch antenna of claim 5, wherein the structure comprises a plurality of notches on opposite edges of the patch, the notches extending toward opposite ends of the enclosed cavity.

11. The folded patch antenna of claim 1, wherein the flexible substrate is folded to form a rectangular cavity.

12. The folded patch antenna of claim 1, wherein the flexible substrate is folded to form a cylindrical cavity.

13. The folded patch antenna of claim 1, wherein the flexible substrate is wrapped to form a cylindrical cavity, the cylindrical cavity encircled by multiple layers of the flexible substrate.

14. The folded patch antenna of claim 1, wherein the folded patch antenna is encased in a sealing material.

15. A folded patch antenna platform, comprising:

a flexible substrate having a first surface and a second surface opposite the first surface;

a folded patch antenna comprising a patch disposed on the first surface and a ground plane disposed on the second surface of the flexible substrate; and a transceiver mounted on the flexible substrate, the transceiver communicatively coupled to the patch of the folded patch antenna, where the flexible substrate is folded to form an enclosed cavity defined by at least a portion of the second surface, and the patch is folded to form a folded patch on the first surface of the flexible substrate.

16. The folded patch antenna platform of claim 15, further comprising a microprocessor mounted on the flexible substrate, the microprocessor communicatively coupled to the transceiver.

17. The folded patch antenna platform of claim 16, further comprising one or more sensors mounted on the flexible substrate.

18. The folded patch antenna platform of claim 15, wherein the flexible substrate is wrapped to form a cylindrical structure with the patch of the folded patch antenna on an outer surface of the cylindrical structure.

19. The folded patch antenna platform of claim 18, wherein the transceiver is shielded from electromagnetic interference (EMI) by the ground plane of the folded patch antenna.

20. The folded patch antenna platform of claim 18, wherein the wrapped folded patch antenna platform is encased in a biocompatible material.

* * * * *